US010688366B1

(12) United States Patent
Petrich et al.

(10) Patent No.: US 10,688,366 B1
(45) Date of Patent: Jun. 23, 2020

(54) GOLF BALL WITH ELECTRICAL COMPONENTS

(71) Applicant: Callaway Golf Company, Carlsbad, CA (US)

(72) Inventors: Petra Petrich, Escondido, CA (US); David Bartels, Carlsbad, CA (US); Mario Raposo, Carlsbad, CA (US); Grady Crahan, Carlsbad, CA (US); Nick Lannes, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 16/509,232

(22) Filed: Jul. 11, 2019

Related U.S. Application Data

(60) Provisional application No. 62/697,584, filed on Jul. 13, 2018.

(51) Int. Cl.
*A63B 43/06* (2006.01)
*A63B 37/00* (2006.01)
*A63B 69/36* (2006.01)

(52) U.S. Cl.
CPC ..... *A63B 69/3658* (2013.01); *A63B 37/0022* (2013.01); *A63B 37/0051* (2013.01); *A63B 69/3655* (2013.01); *A63B 2220/34* (2013.01); *A63B 2220/833* (2013.01)

(58) Field of Classification Search
USPC ..... 473/351–378, 570, 571
See application file for complete search history.

(56) References Cited

U.S. PATENT DOCUMENTS 3,351,347 A * 11/1967 Smith ..... A63B 43/06 473/199
5,112,055 A 5/1992 Barnhill
5,447,314 A 9/1995 Yamazaki et al.
5,820,484 A 10/1998 Terry
5,965,669 A 10/1999 Cavallaro et al.
6,042,487 A * 3/2000 Schrimmer ..... A63B 37/0003 473/353
6,245,859 B1 6/2001 Sullivan et al.
6,440,012 B1 * 8/2002 Nesbitt ..... A63B 37/0003 473/372
6,450,898 B1 * 9/2002 Nesbitt ..... A63B 37/0003 473/372
6,525,139 B2 * 2/2003 Takesue ..... C08F 8/30 473/378

(Continued)

FOREIGN PATENT DOCUMENTS

EP 1176171 A2 * 1/2002 ..... C08L 63/00

OTHER PUBLICATIONS

Office Action for U.S. Appl. No. 15/785,163, dated Jun. 26, 2018.

(Continued)

*Primary Examiner* — Alvin A Hunter
(74) *Attorney, Agent, or Firm* — Michael A. Catania; Sonia Lari; Rebecca Hanovice

(57) ABSTRACT

A golf ball comprising an electrical component is disclosed herein. The electrical component comprises an integrated circuit having a gyroscope, a magnetometer, and a BLUETOOTH low energy (BTLE) radio, and at least one battery. A body is composed of an epoxy material, and the body encompasses the electrical component.

18 Claims, 27 Drawing Sheets

(56) References Cited

U.S. PATENT DOCUMENTS 6,692,380 B2 * 2/2004 Sullivan ..... A63B 37/0003 473/351
6,712,487 B2 * 3/2004 Liou ..... A63B 37/0003 362/253
6,780,126 B2 * 8/2004 Ladd ..... A63B 37/0003 473/376
6,806,347 B2 * 10/2004 Hogge ..... A63B 37/0003 473/354
6,852,043 B2 * 2/2005 Sullivan ..... A63B 37/0003 473/374
6,855,073 B1 * 2/2005 Keller ..... A63B 37/0003 473/374
6,916,254 B2 * 7/2005 Ladd ..... A63B 37/0003 473/376
7,014,575 B2 * 3/2006 Sullivan ..... A63B 37/0003 473/371
7,059,974 B1 6/2006 Golliffe et al.
7,115,049 B2 * 10/2006 Sullivan ..... A63B 37/0003 473/376
7,306,528 B2 * 12/2007 Jordan ..... A63B 37/0003 473/376
7,367,903 B2 5/2008 Matroni et al.
7,614,959 B1 * 11/2009 Gentile ..... A63B 24/0021 463/30
7,641,841 B2 1/2010 Melanson
7,691,009 B2 * 4/2010 Savarese ..... A63B 24/0021 473/353
7,785,522 B2 8/2010 Dewanjee et al.
8,355,869 B2 1/2013 Balardeta et al.
8,540,583 B2 * 9/2013 Leech ..... A63B 24/0021 473/152
8,747,241 B2 * 6/2014 Molinari ..... A63B 37/0003 473/131
8,764,588 B2 * 7/2014 Gill ..... A63B 43/06 473/465
8,845,459 B2 9/2014 Balardeta et al.
8,972,102 B2 * 3/2015 Reindl ..... A63B 43/00 473/131
8,974,266 B2 * 3/2015 Liao ..... G02B 5/0236 446/175
8,974,318 B1 3/2015 Ogg et al.
8,992,346 B1 3/2015 Raposo
9,278,260 B1 3/2016 Bartels
9,498,680 B2 * 11/2016 Luciano, Jr. ..... A63B 37/005
9,522,306 B1 * 12/2016 Ganson ..... A63B 43/004
9,597,567 B1 * 3/2017 Tran ..... A63B 60/46
9,682,305 B2 * 6/2017 Kim ..... A63B 69/3608
9,694,247 B2 * 7/2017 Nurnberg ..... A63B 43/004
9,707,454 B1 7/2017 Simonds et al.
9,789,366 B1 10/2017 Chavan et al.
10,204,456 B2 * 2/2019 Kudirka ..... A63B 37/02
10,232,225 B1 * 3/2019 Oberc ..... A63B 69/3632
10,252,117 B1 * 4/2019 Simonds ..... A63B 37/009
10,315,077 B2 * 6/2019 Komatsu ..... A63B 43/004
10,428,216 B2 * 10/2019 Sullivan ..... A63B 37/0022
10,493,329 B1 * 12/2019 Luciano, Jr. ..... A63B 37/0003
2002/0022537 A1 2/2002 Nesbitt et al.
2003/0096664 A1 5/2003 Jordan
2005/0227792 A1 * 10/2005 McCreary ..... A63B 24/0003 473/409
2005/0233815 A1 * 10/2005 McCreary ..... A63B 24/0021 473/131
2006/0105857 A1 * 5/2006 Stark ..... A63B 24/0021 473/353
2007/0015605 A1 1/2007 Kim et al.
2007/0173349 A1 * 7/2007 Eng ..... A63B 37/0003 473/353
2009/0197704 A1 8/2009 Sullivan et al.
2009/0280921 A1 11/2009 Rankin
2010/0081517 A1 4/2010 Sullivan et al.
2011/0081988 A1 4/2011 Comeau et al.
2013/0196787 A1 8/2013 Luciano
2013/0203518 A1 8/2013 Hatton et al.
2015/0072811 A1 3/2015 Jolliffe et al.
2015/0094168 A1 4/2015 Unger, Sr. et al.
2015/0105173 A1 4/2015 Thurman et al.
2015/0335946 A1 11/2015 Crowder et al.
2016/0279482 A1 9/2016 DuFaux et al.
2018/0021630 A1 1/2018 Monnin et al.
2018/0161640 A1 6/2018 Lin et al.
2018/0214758 A1 * 8/2018 Mosher ..... A63B 69/3658
2018/0236303 A1 8/2018 Mathar et al.
2018/0272221 A1 9/2018 Sundararajan et al.
2019/0036360 A1 * 1/2019 Zilles ..... A63B 71/0669

OTHER PUBLICATIONS

Office Action for U.S. Appl. No. 16/157,998, dated Jul. 18, 2019.

* cited by examiner

GOLF BALL WITH ELECTRICAL COMPONENTS

CROSS REFERENCE TO RELATED APPLICATION

The Present Application claims priority to U.S. Provisional Patent Application No. 62/697,584, filed on Jul. 13, 2018, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to golf balls. Particularly to golf balls with internal electronics.

Description of the Related Art

Most patents that have been filed looking at communicating between a ball and a device involve only trying to find the golf ball using RFID type circuitry. Most of the designs will only be successful in getting a user close to the position of the golf ball.

In regards to the spin measurement, most spin measurement devices use Doppler technology to measure the ball as it spins, this method produces inconsistent results that have aliasing issues at times.

BRIEF SUMMARY OF THE INVENTION

One aspect of the present invention is a golf ball comprising an epoxy sphere, a core layer and a cover layer. The epoxy sphere comprises a body and an electronic component. The electronic component comprises a plurality of stacked circuit boards and at least one battery disposed within the plurality of stacked circuit boards. The body is composed of an epoxy material. The body encompasses the electronic component. The core layer is disposed on the epoxy sphere. The cover layer is disposed over the core layer.

Another aspect of the present invention is a golf ball comprising an epoxy sphere, a core layer, a mantle layer and a cover. The epoxy sphere comprises a body and an electronic component. The electronic component comprises a plurality of stacked circuit boards and at least one battery disposed within the plurality of stacked circuit boards. The body is composed of an epoxy material and encompasses the electronic component. The core layer is disposed on the epoxy sphere, and comprises a polybutadiene and a graphene material in an amount ranging from 0.1 to 5.0 weight percent of the outer core. The outer core has a flexural modulus ranging from 80 MPa to 95 MPa.

This new design preferably uses a triangulation method to guide a player to a very close region around the golf ball.

By placing a magnetometer in the ball, the exact spin values are recorded (up to 5000 RPM).

The golf ball preferably creates a compact design due to the circuit board composed of a flexible material, such that the circuit board is wrapped around the batteries.

Another important aspect of the present invention is that the circuit board attaches directly to the battery using three contact points: one positive pad and two negative contacts, including the actual crystal cover.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The two main advantages to the consumer will be a golf ball that records spin and a golf ball that can be easily found.

A magnetometer, preferably running at 85 Hz, inside a golf ball is able to measure spins of 5000 RPM. Measuring higher spin rates is also possible.

The entire circuitry is preferably inside a hard plastic molded sphere.

Data is transferred via BLE radio to a mobile device (in this case a phone).

The circuitry inside the ball preferably activates at impact using a shock switch for power savings. At rest, after the shot, the ball keeps sending the data and going back to sleep mode every second until the user finds it using the mobile device and acknowledges it in the application.

A golf ball is found using triangulation of the RSSI from the golf ball to the mobile device. The user will be instructed to move forward and to the side to generate enough space for the triangulation.

Internal circuitry is embedded within the golf ball. The internal circuitry comprises at least a BLUETOOTH Low Energy radio (5th generation), a processor, a magnetometer, an accelerometer, and a battery. The internal circuit may also have a memory. A KIONIX chip is preferred. The $5^{th}$ generation BLUETOOTH Low Energy radio has a range of at least 700 meters. Triangulation is used to find a golf ball on course. The battery is preferably a 2032 coin cell. A NF52 Nordic processor is preferably utilized. A KIONIX 3-axis accelerometer is preferably utilized.

Figure 1:
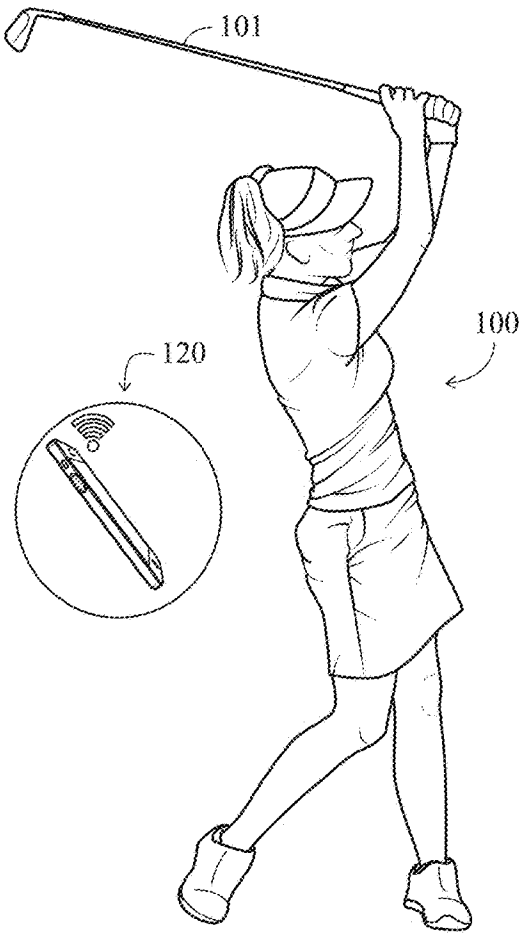
FIG. 1 is an illustration of a golfer hitting a golf ball with internal circuitry according to the present invention therein.

As shown in FIG. 1, a golfer 100 swings a golf club 101 to hit a golf ball 10 with internal circuitry according to the present invention therein. A mobile device 120, such as a mobile phone, receives a BLUETOOTH low energy wireless communication transmission from the golf ball 10.

Figure 2:
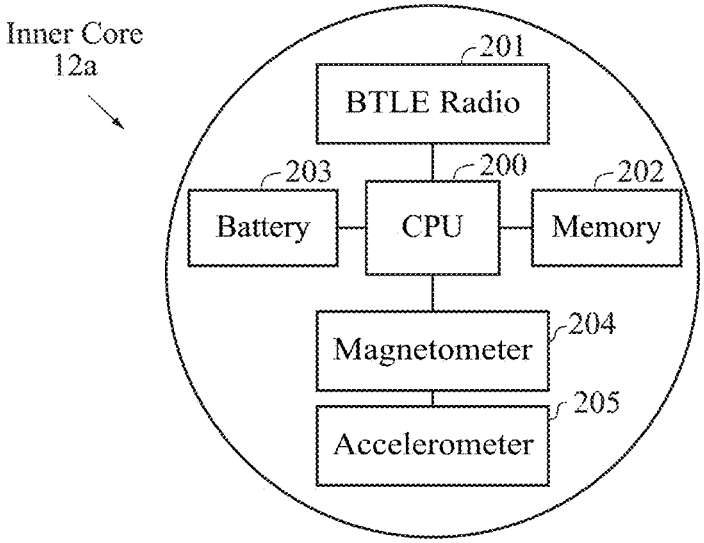
FIG. 2 is a block diagram of the internal circuitry.

FIG. 2 is a block diagram of the internal circuitry within the inner core 12*a* of the golf ball 10. The internal circuitry preferably includes a CPU 200, a BTLE radio 201, a memory 202, a battery 203, a magnetometer 204 and an accelerometer 205.

Figure 3:
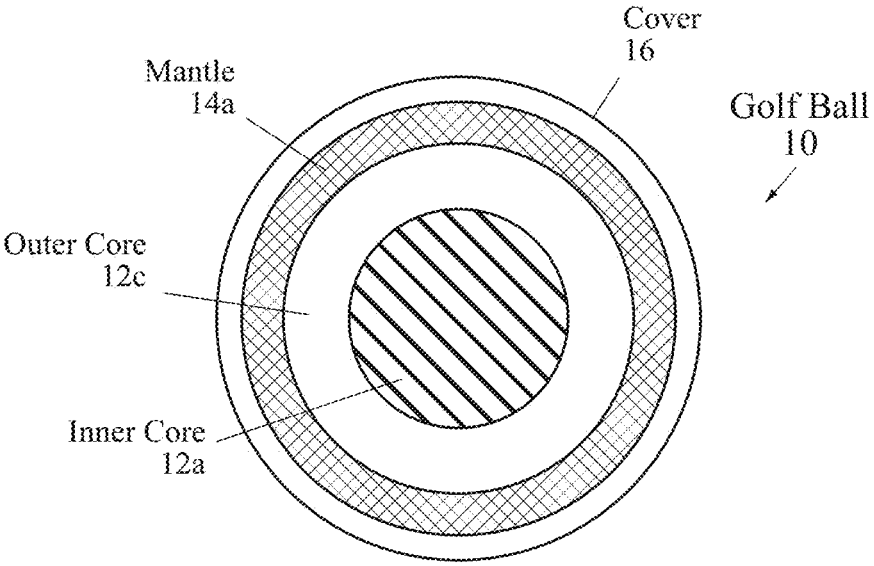
FIG. 3 is a cross-sectional view of a golf ball with an internal circuitry therein.

FIG. 3 is a cross-sectional view of a golf ball with an internal circuitry therein. The inner core 12*a* is preferably composed of an epoxy material.

Figure 4:
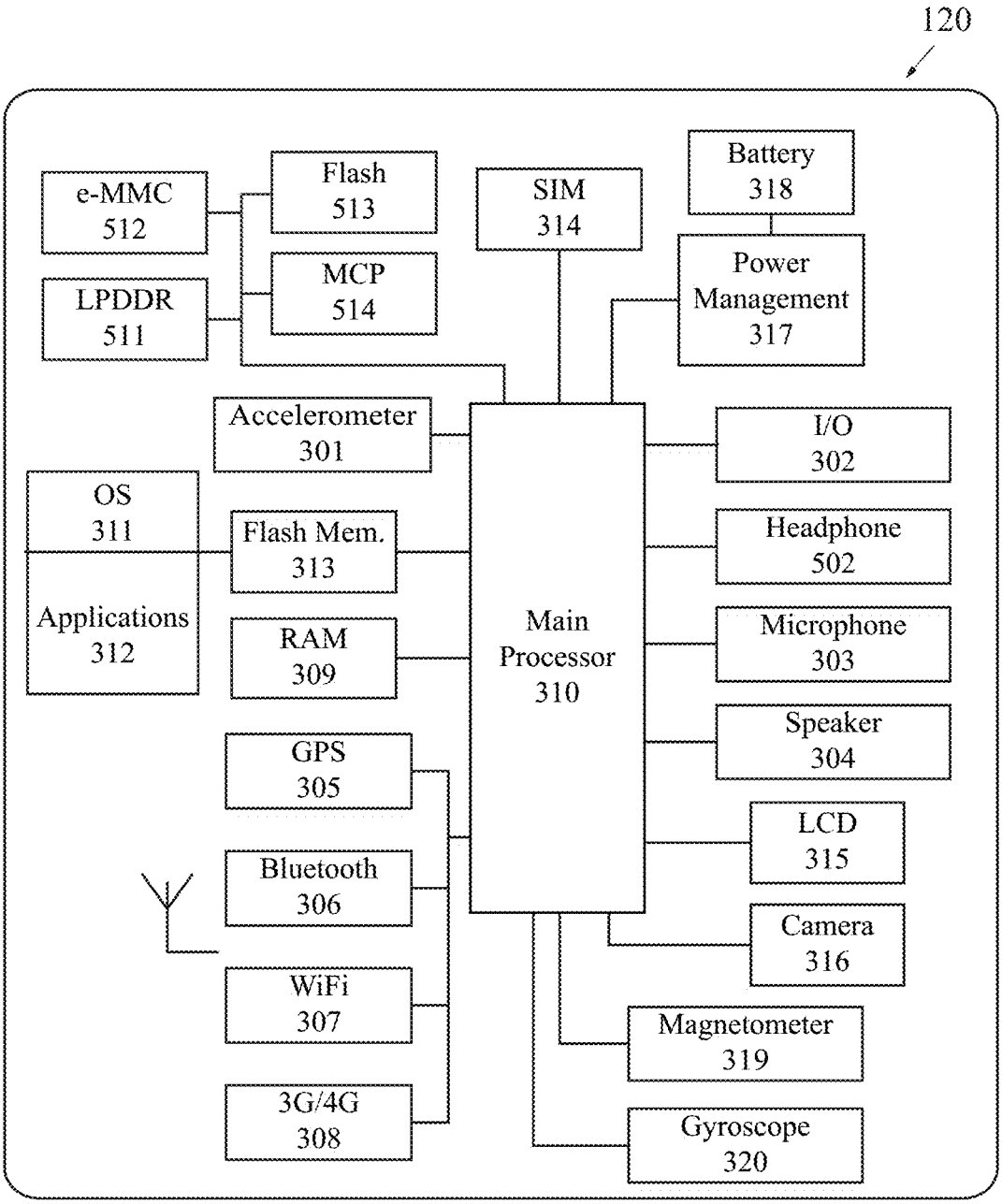
FIG. 4 is a block diagram of components of a mobile device.

FIG. 4 is a block diagram of components of a mobile device 120. The mobile device 120 preferably comprises an accelerometer 301, an input/output module 302, a microphone 303, a speaker 304, a GPS 305, a BLUETOOTH transceiver 306, a WiFi transceiver 307, a 3G/4G transceiver 308, a RANI memory 309, a main processor 310, an operating system (OS) module 311, an applications module 312, a flash memory 313, a SIM card 314, a LCD display 315, a camera 316, a power management module 317, a battery 318, a magnetometer 319, a gyroscope 320*a* LPDDR module 511, a e-MMC module 512, a flash module 513, and a MCP module 514.

Figure 5:
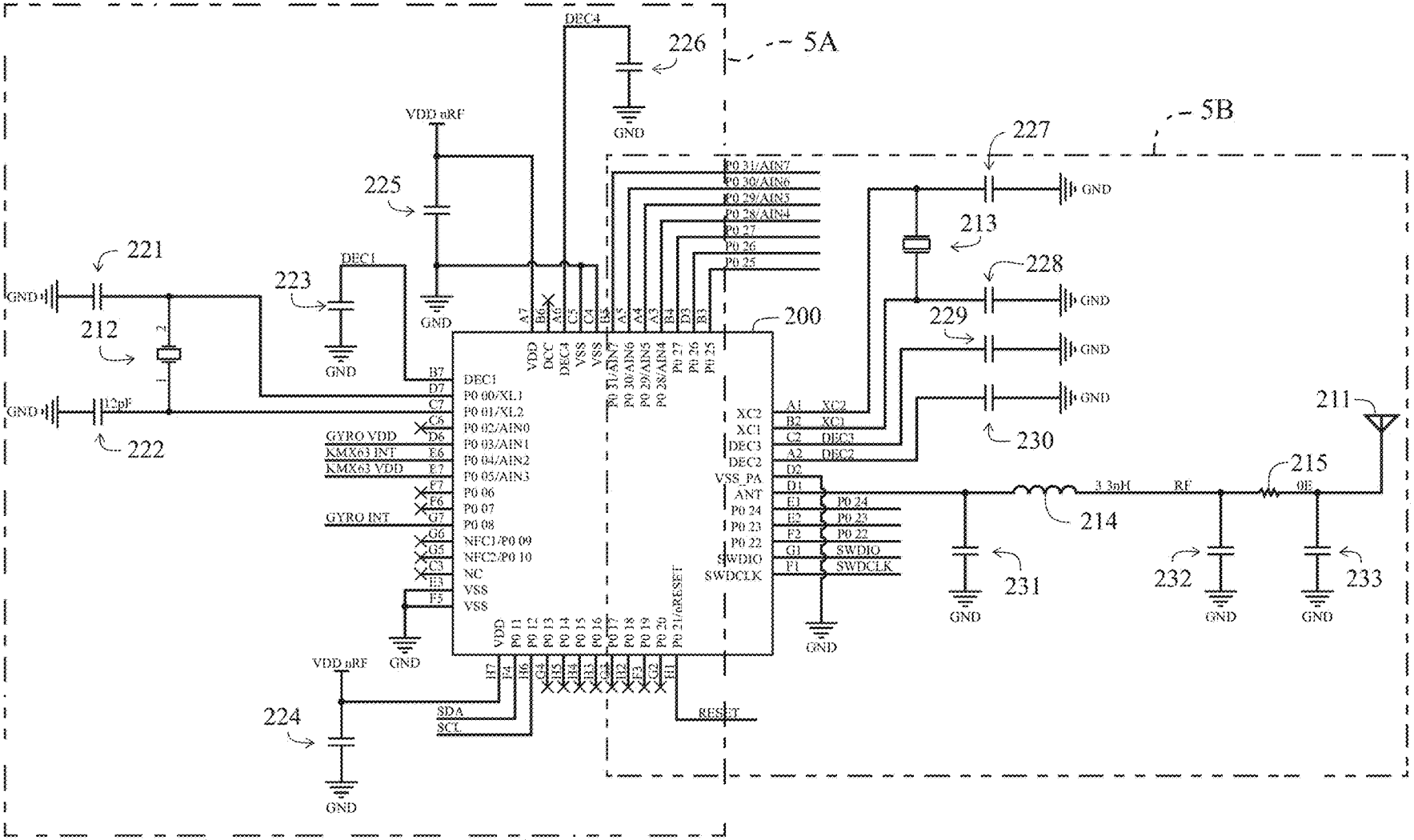
FIG. 5 is a circuit diagram.
Figure 5A:
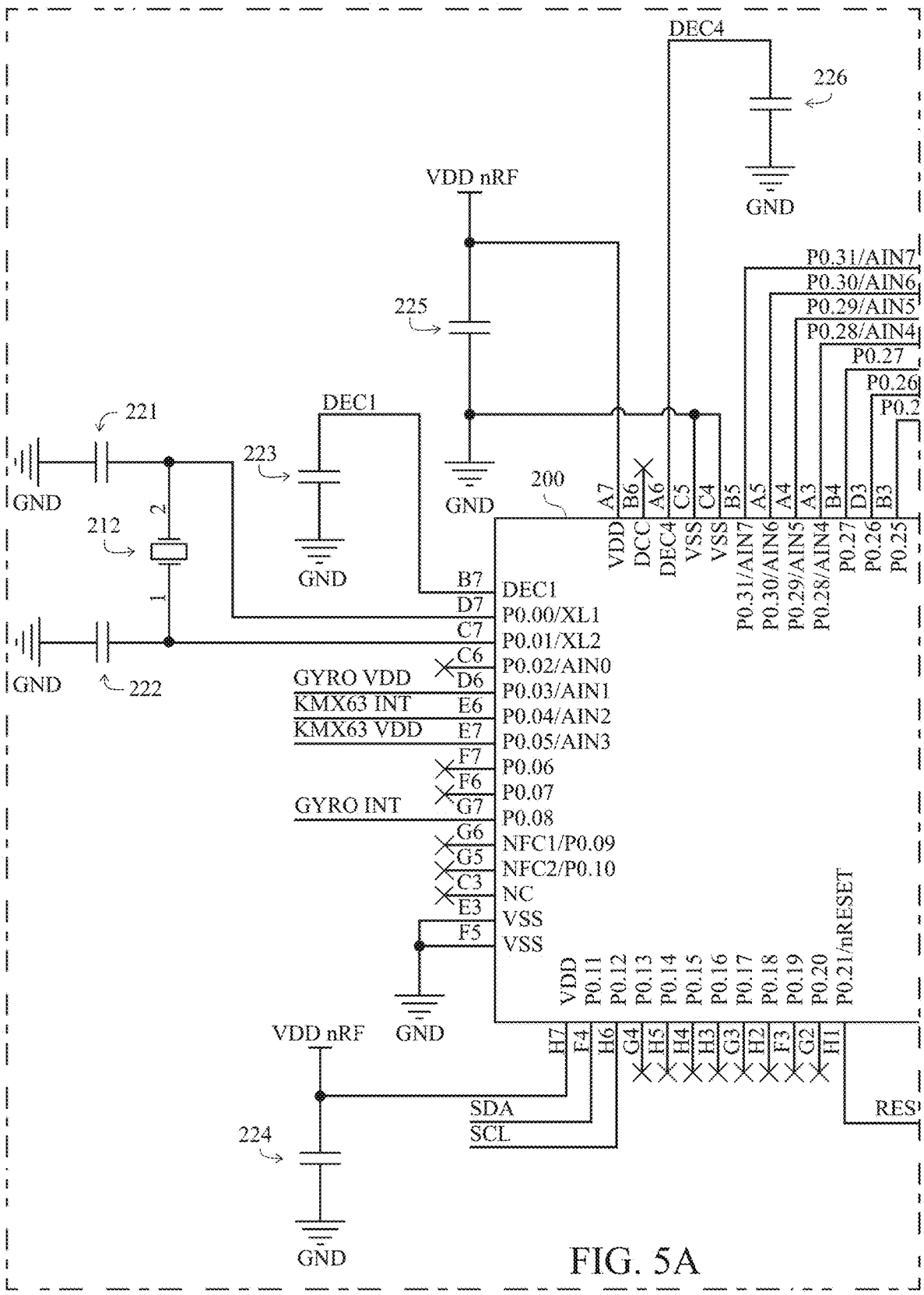
FIG. 5A is a circuit diagram.
Figure 5B:
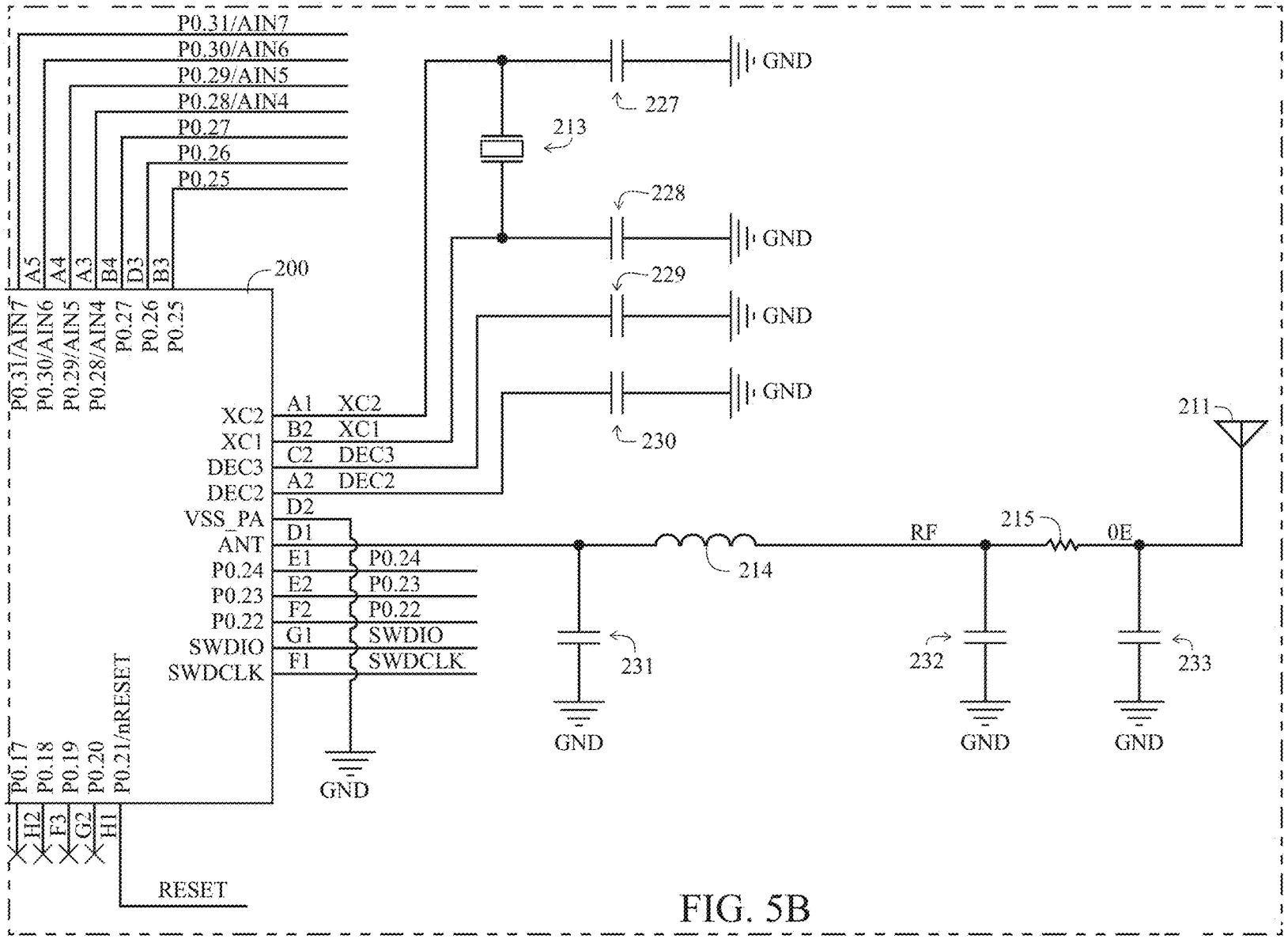
FIG. 5B is a circuit diagram.

FIGS. 5, 5A and 5B illustrate circuit diagrams of the internal circuitry of the golf ball 10. The internal circuitry preferably includes a CPU 200, an antenna 211, a first crystal oscillator 212, a second crystal oscillator (XTAL SMD 2016, 32 MHz) 213, an inductor (3.3 nH) 214, a resistor 215, a first capacitor (12 picoFaradays "pF") 221, a second capacitor (12 pF) 222, a third capacitor (100 nano Faradays "nF") 223, a fourth capacitor (100 nF) 224, a fifth capacitor (4.7 microFaradays "uF") 225, a sixth capacitor (100 nF) 226, a seventh capacitor (12 pF) 227, an eighth capacitor (12 pF) 228, a ninth capacitor (100 pF) 229, a tenth capacitor (100 pF) 230, an eleventh capacitor (100 nF) 231, a twelfth capacitor (NS) 232, and a thirteenth capacitor (NS) 233.

Figure 5C:
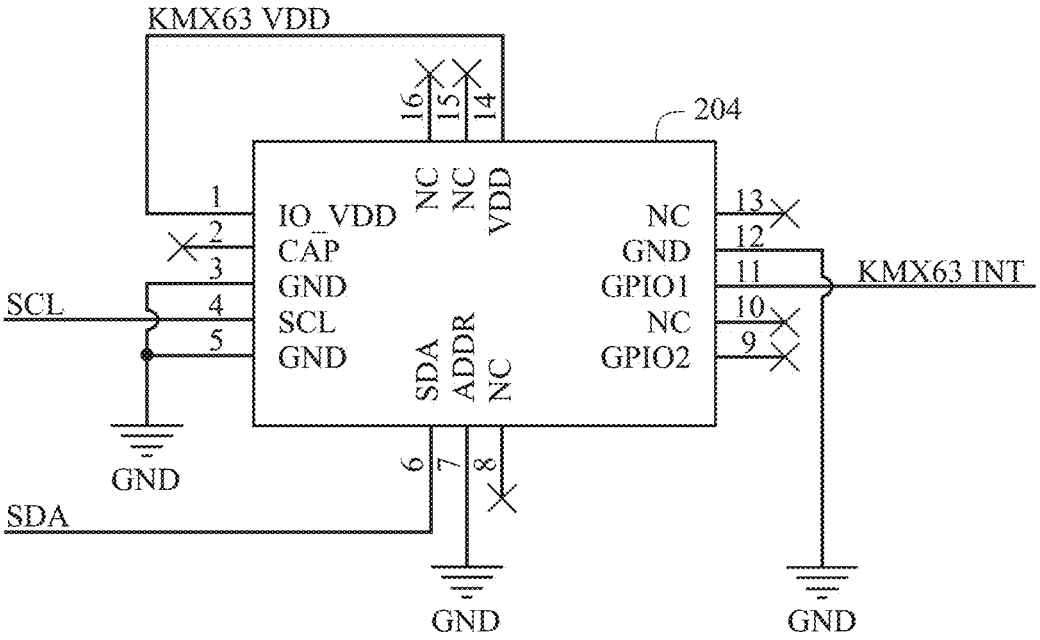
FIG. 5C is a circuit diagram.

FIG. 5C is a circuit diagram of magnetometer/accelerometer 204, preferably a medium-G, wide bandwidth tri-axis magnetometer/tri-axis accelerometer.

Figure 5D:
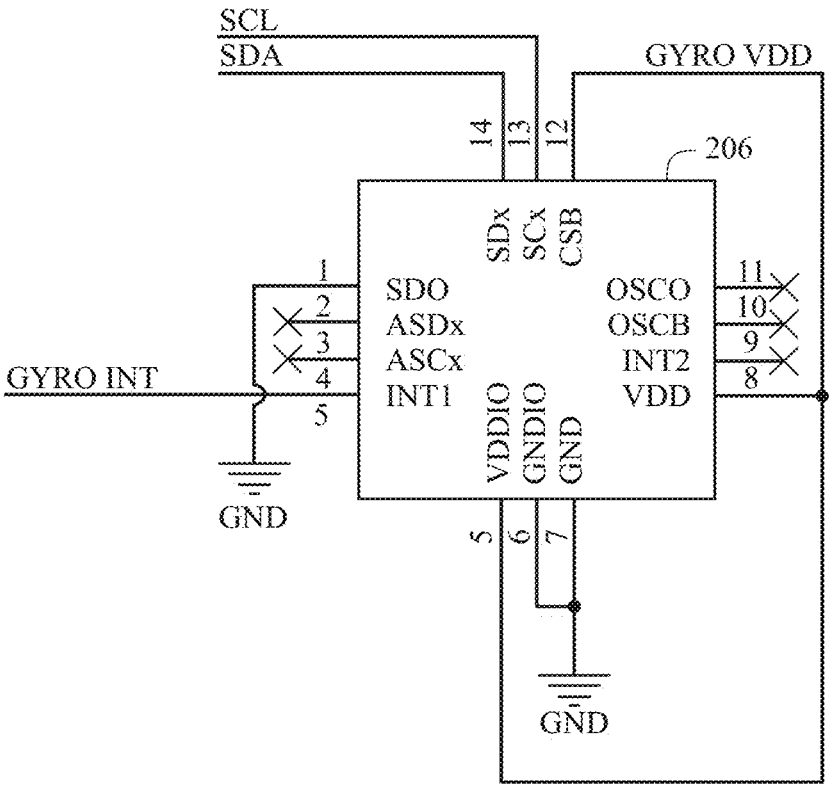
FIG. 5D is a circuit diagram.

FIG. 5D is a circuit diagram for a gyroscope 206, preferably a BOSCH SENSORTEC BMG250 gyroscope.

Figure 5E:
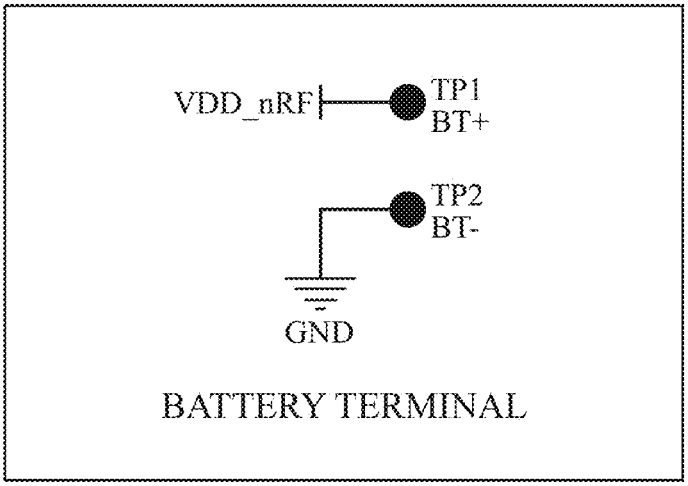
FIG. 5E is a circuit diagram.

FIG. 5E is a circuit diagram of a battery terminal.

Figure 5F:
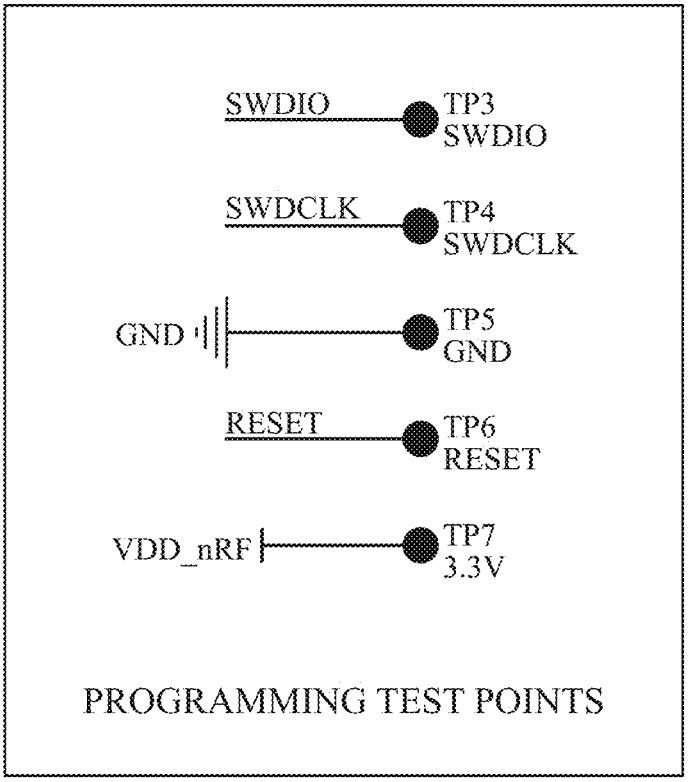
FIG. 5F is a circuit diagram.

FIG. 5F is a circuit diagram of programming test points.

Figure 6:
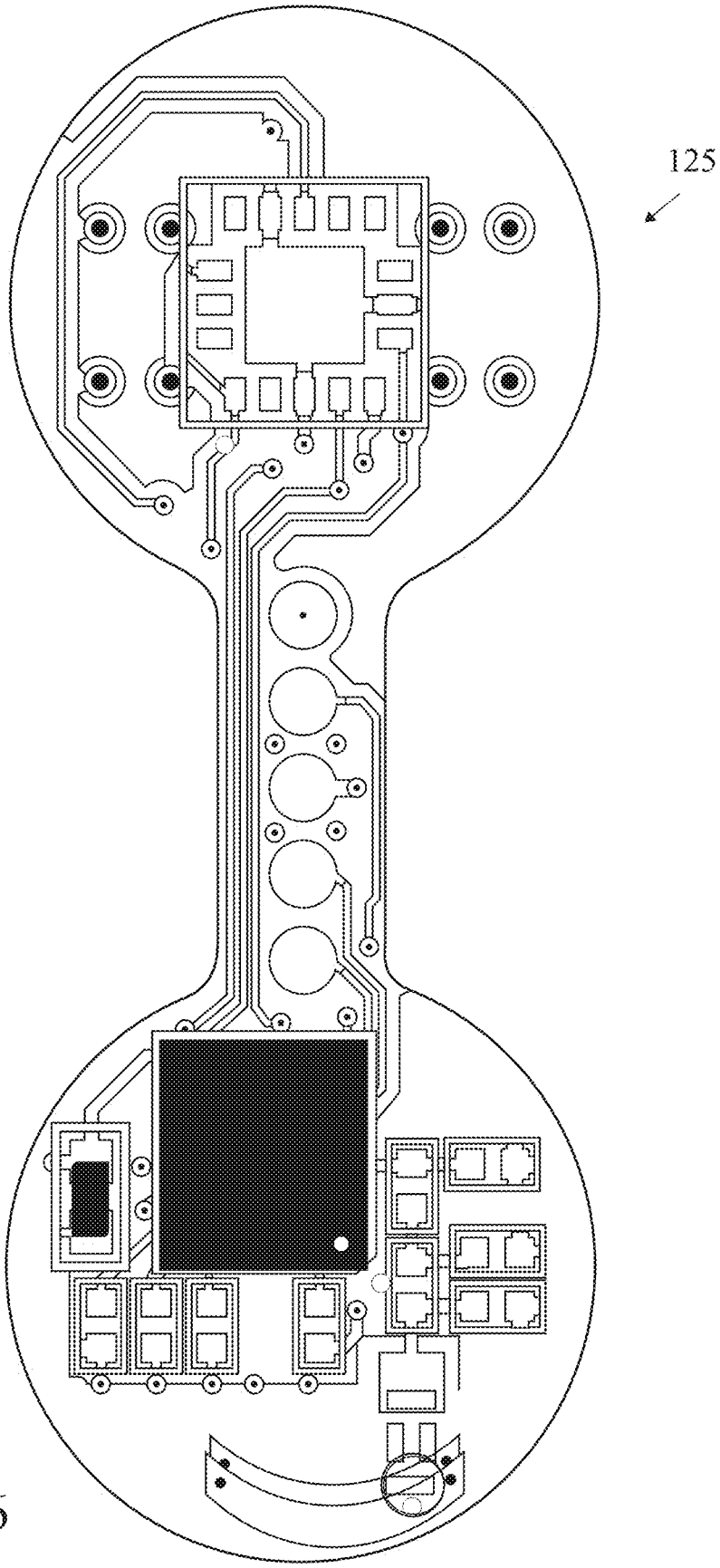
FIG. 6 is a top plan view of a flexible circuit board.

FIG. 6 is a top plan view of a flexible circuit board 125.

Figure 7:
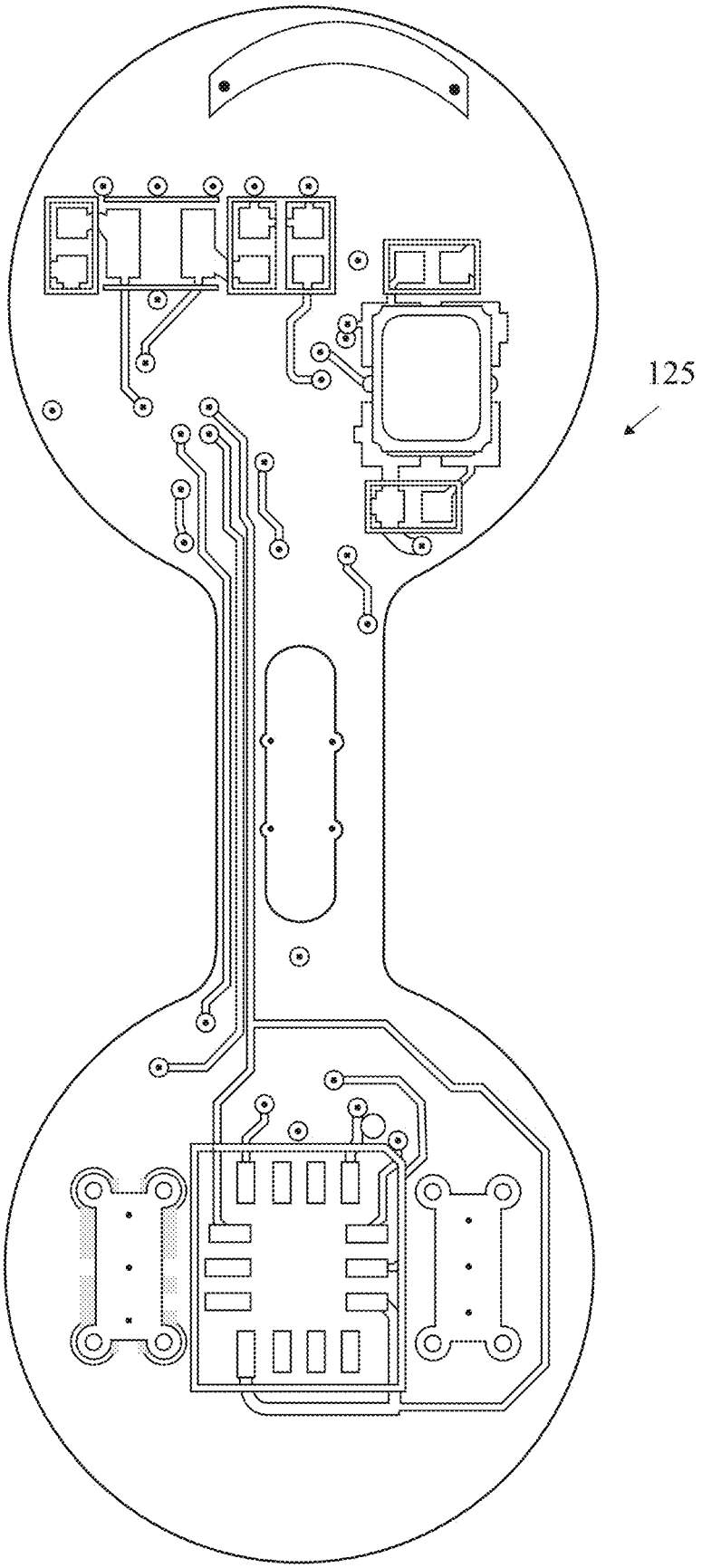
FIG. 7 is a bottom plan view of a flexible circuit board.

FIG. 7 is a bottom plan view of a flexible circuit board 125.

Figure 8:
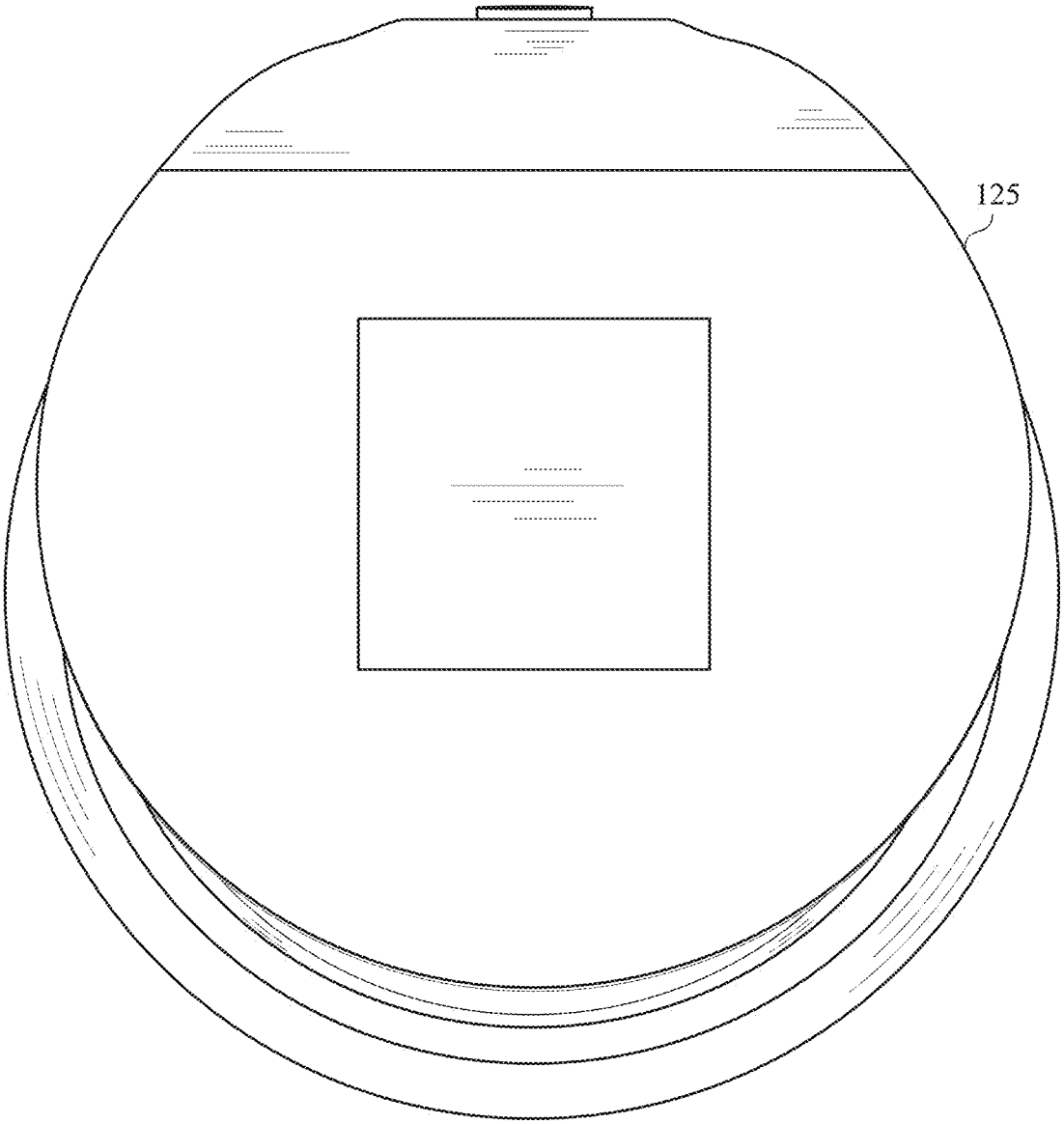
FIG. 8 is an illustration of an electronic component.

FIG. 8 is an illustration of a folded flexible circuit board 125.

Figure 9:
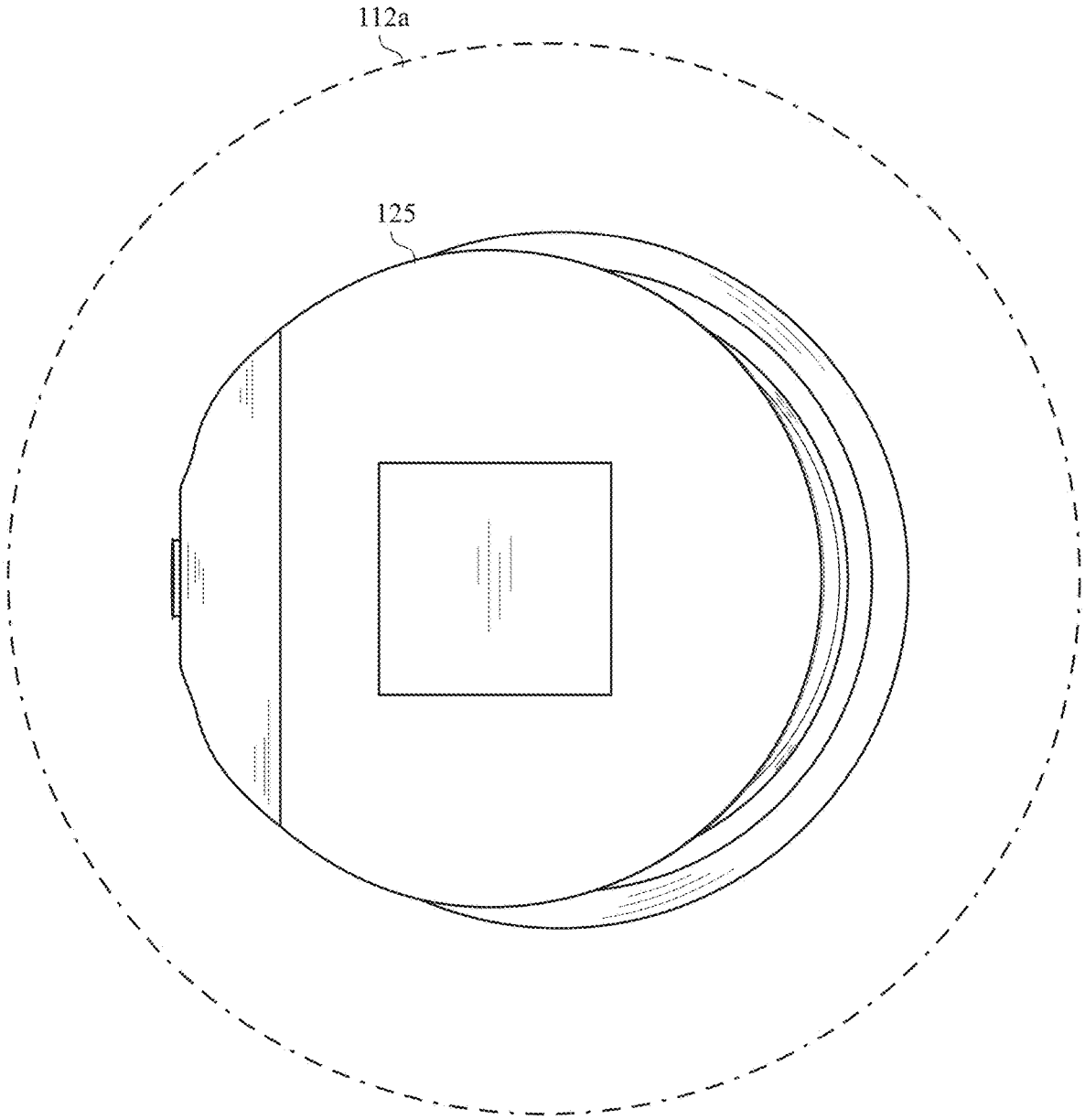
FIG. 9 is an illustration of an electronic component within an epoxy sphere for a golf ball.

FIG. 9 is an illustration of a folded flexible circuit board 125 within an epoxy sphere core 112*a* of a golf ball.

Figure 10:
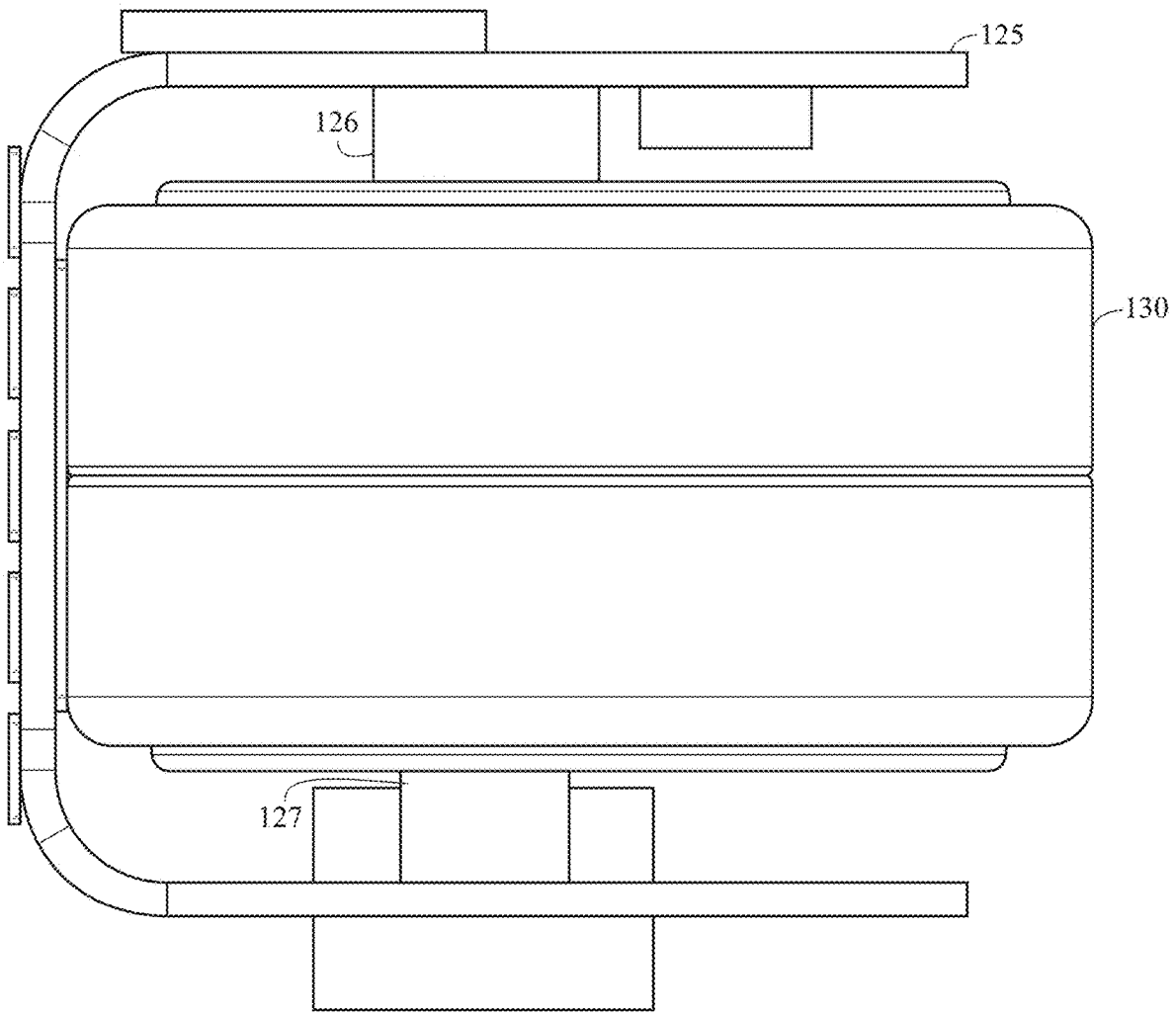
FIG. 10 is an illustration of a flexible circuit board wrapped around multiple batteries.

FIG. 10 is an illustration of a flexible circuit board 125 wrapped around multiple batteries 130 and connected to the batteries 130 by contacts 126 and 127.

Figure 10A:
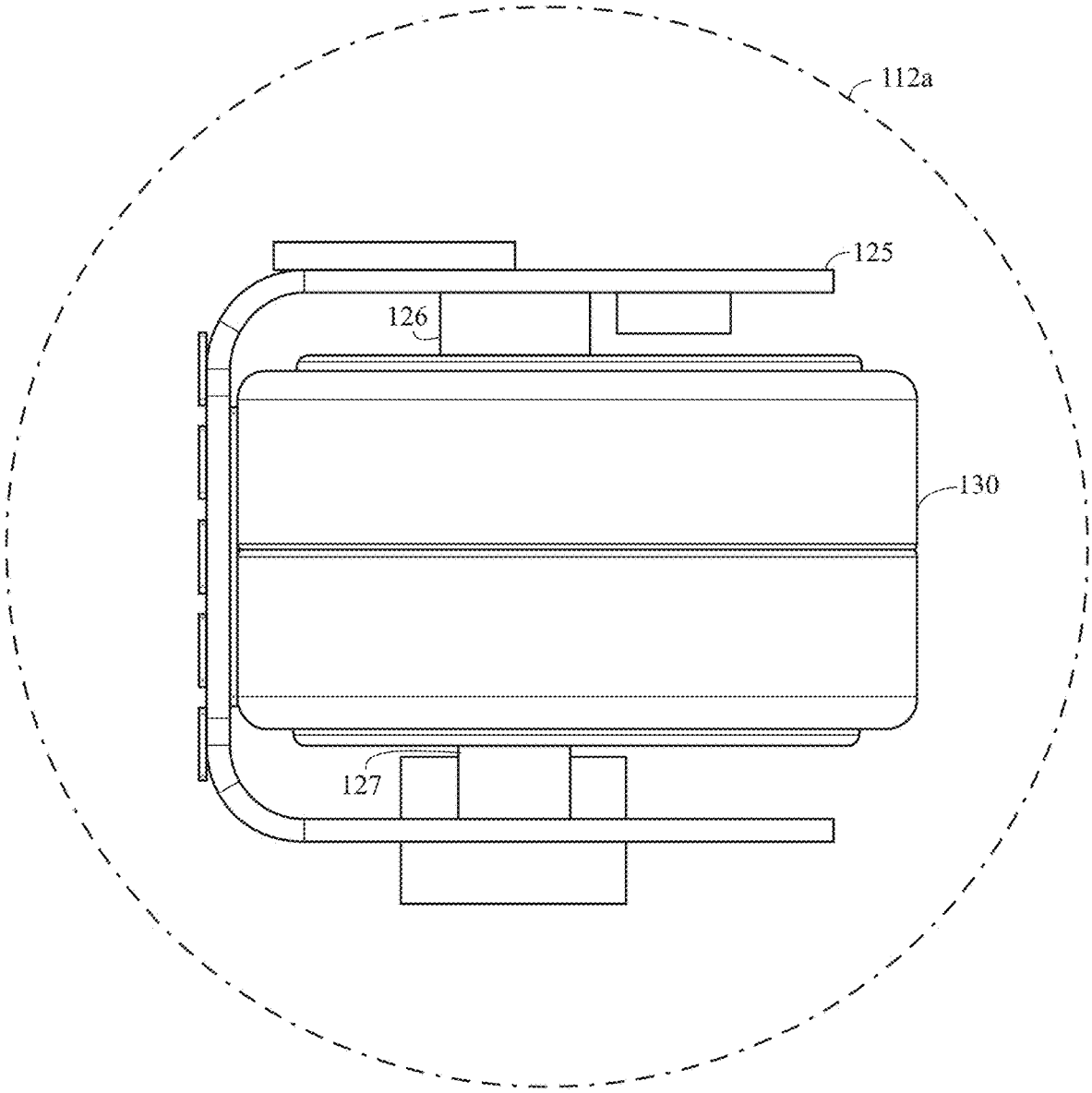
FIG. 10A is an illustration of a flexible circuit board wrapped around multiple batteries within an epoxy sphere for a golf ball.
Figure 11:
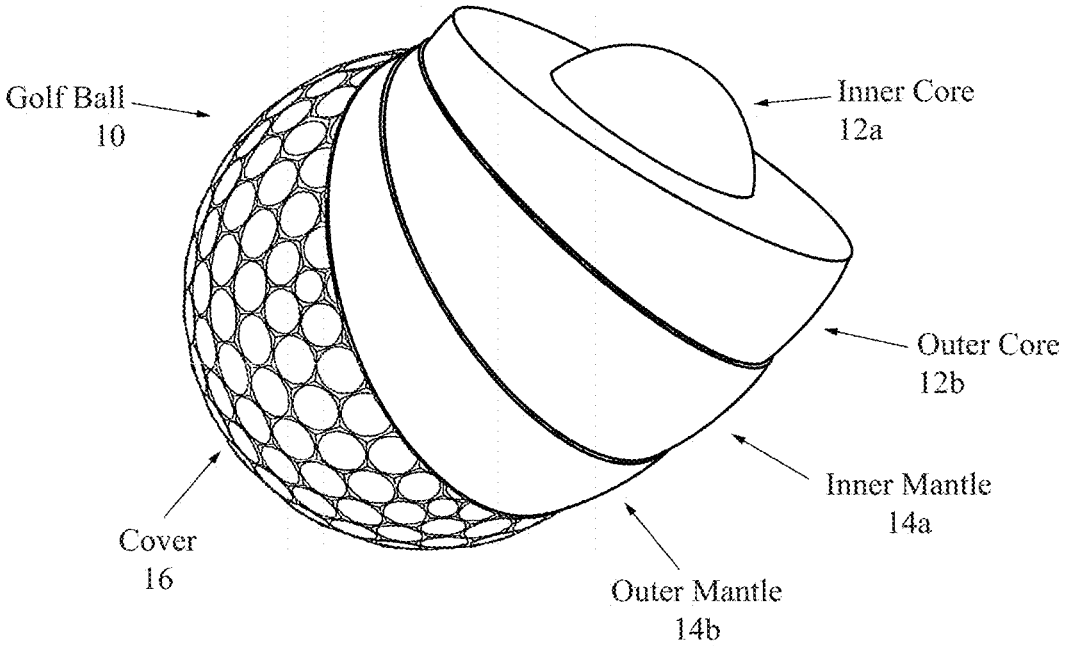
FIG. 11 is an exploded partial cut-away view of a golf ball.
Figure 12:
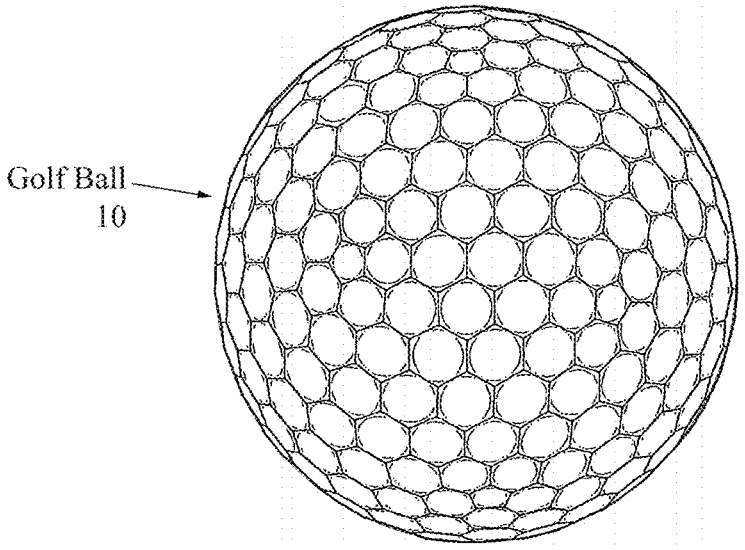
FIG. 12 is top perspective view of a golf ball.
Figure 13:
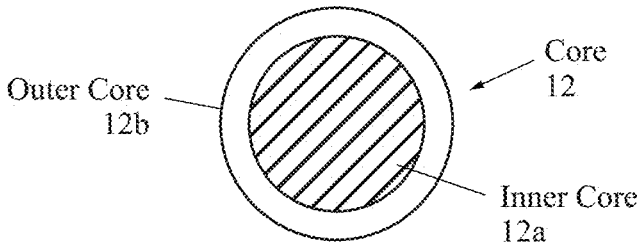
FIG. 13 is a cross-sectional view of a core component of a golf ball.
Figure 14:
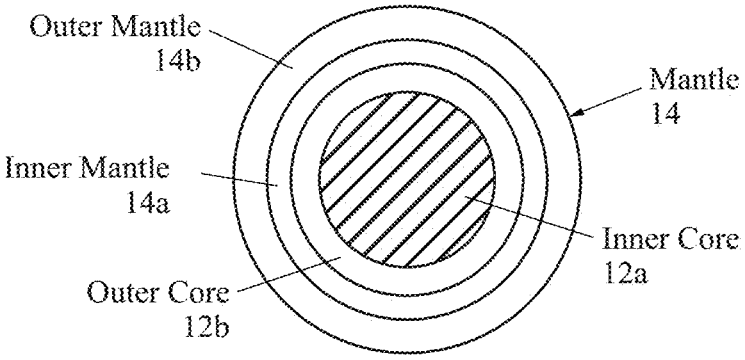
FIG. 14 is a cross-sectional view of a core component and a mantle component of a golf ball.

FIG. 10A is an illustration of a flexible circuit board 125 wrapped around multiple batteries 130 and connected to the batteries 130 by contacts 126 and 127, and within an epoxy sphere core 112*a* for a golf ball.

One embodiment is a golf ball 10 comprising an epoxy sphere 112*a*, a core layer and a cover layer. The epoxy sphere 112*a* comprises a body and at least one electrical component 125. The electrical component preferably comprises a plurality of stacked circuit boards and at least one battery 130 disposed within the plurality of stacked circuit boards. The body is preferably composed of an epoxy material. The body encompasses the electrical component. The core layer is disposed on the epoxy sphere. The cover layer is disposed over the core layer.

The core layer preferably comprises polybutadiene material and a graphene material in an amount ranging from 0.1 to 5.0 weight percent of the outer core, wherein the outer core has a flexural modulus ranging from 80 MPa to 95 MPa.

The plurality of stacked circuit boards preferably comprises an integrated circuit, a gyroscope, a magnetometer, and an antenna.

The electrical component preferably has a width ranging from 5 to 20 mm, a height ranging from 5-20 mm and a length ranging from 5-20 mm.

The epoxy sphere preferably has a diameter ranging from 0.4 inch to 0.9 inch, and more preferably a diameter ranging from 0.45 inch to 0.6 inch.

The integrated circuit is preferably flexible and is wrapped around the at least one battery.

The integrated circuit is attached to the at least on battery at three contact points.

The electrical component is preferably centered within the epoxy sphere.

The integrated circuit comprises a BLUETOOTH antenna, a 1 GigaHertz antenna, a microcontroller and a radiofrequency transceiver.

The integrated circuit preferably comprises a plurality of capacitors and at least one inductor.

The electrical component is preferably detects a spin of the golf ball and transmits a signal to a mobile device.

FIGS. 11, 13, 14 and 15 illustrate a five piece golf ball 10 comprising an inner core 12*a*, an outer core 12*b*, an inner mantle 14*a*, an outer mantle 14*b*, and a cover 16, with an internal circuitry comprising at least a BLUETOOTH Low Energy radio (5 generation), a processor, a magnetometer, an accelerometer, and a battery. The internal circuit may also have a memory.

Figure 15:
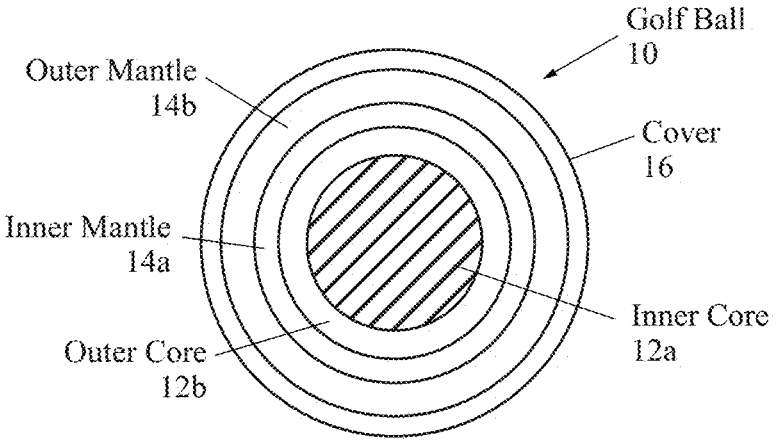
FIG. 15 is a cross-sectional view of an inner core layer, an outer core layer, an inner mantle layer, an outer mantle layer and a cover layer of a golf ball.
Figure 15A:
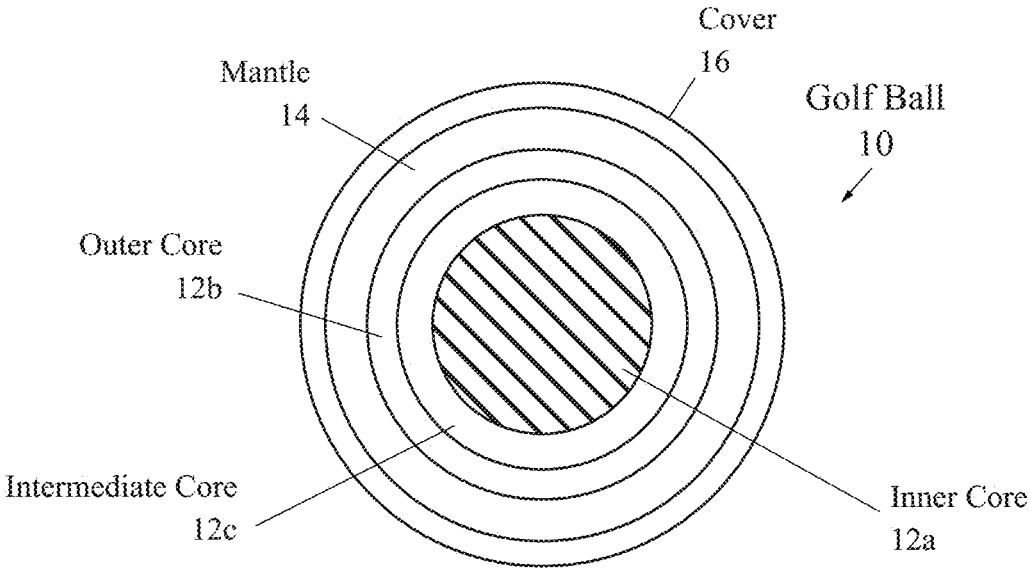
FIG. 15A is a cross-sectional view of an inner core layer, an intermediate core layer, an outer core layer, a mantle layer and a cover layer of a golf ball.

FIG. 15A illustrates a five piece golf ball 10 comprising an inner core 12*a*, an intermediate core 12*b*, an outer core 12*c*, a mantle 14, and a cover 16.

Figure 18:
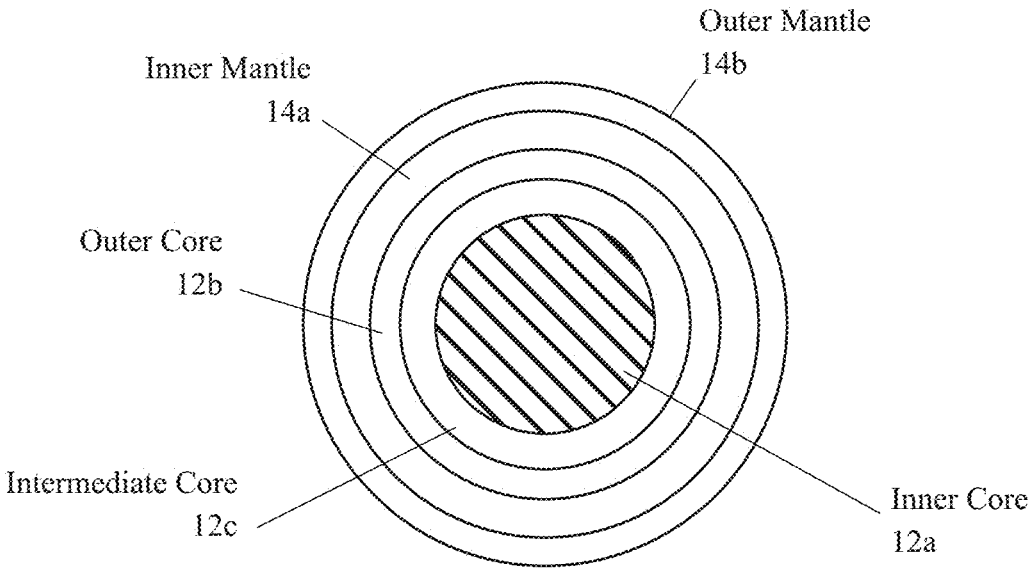
FIG. 18 is a cross-sectional view of a core component and a mantle component of a golf ball.
Figure 19:
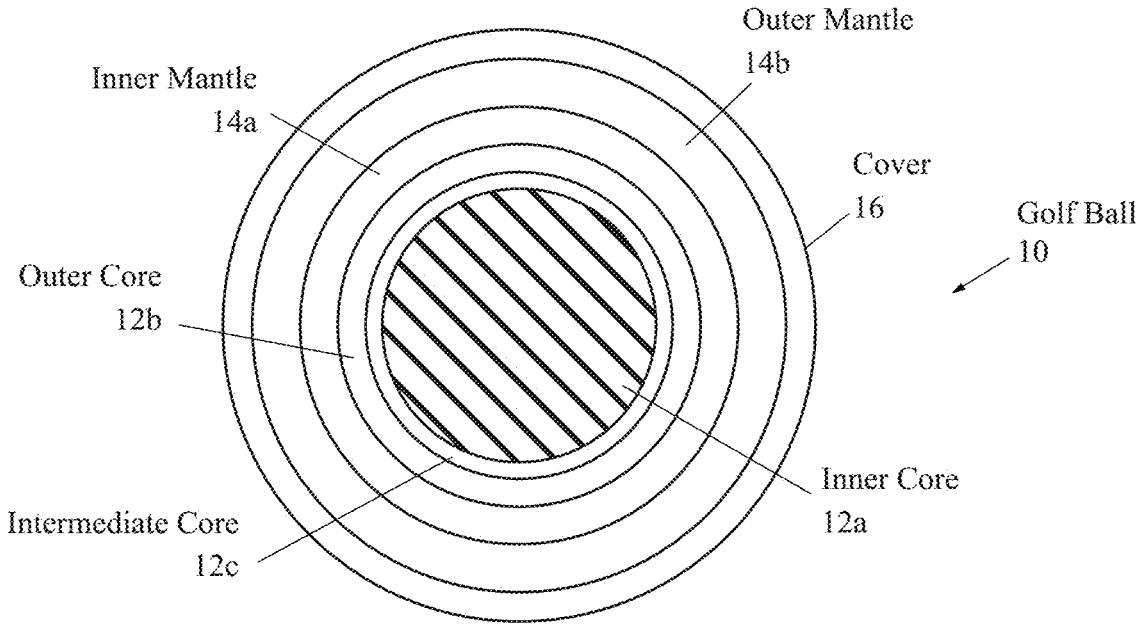
FIG. 19 is a cross-sectional view of a core component, the mantle component and a cover layer of a golf ball.

FIGS. 18 and 19 illustrate a six piece golf ball 10 comprising an inner core 12*a*, an intermediate core 12*b*, an outer core 12*c*, an inner mantle 14*a*, an outer mantle 14*b*, and a cover 16, with an internal circuitry comprising at least a BLUETOOTH Low Energy radio (5 generation), a processor, a magnetometer, an accelerometer, and a battery. The internal circuit may also have a memory.

Figure 20:
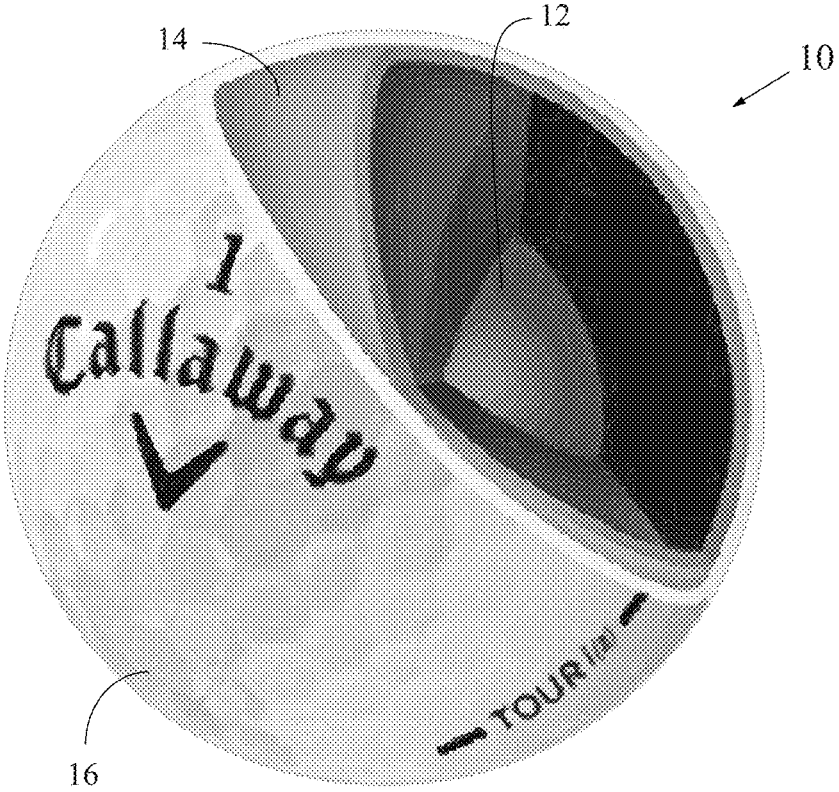
FIG. 20 is an exploded partial cut-away view of a four-piece golf ball.

FIG. 20 illustrates a four piece golf ball comprising a dual core, a boundary layer and a cover, with an internal circuitry comprising at least a BLUETOOTH Low Energy radio (5 generation), a processor, a magnetometer, an accelerometer, and a battery. The internal circuit may also have a memory.

Figure 21:
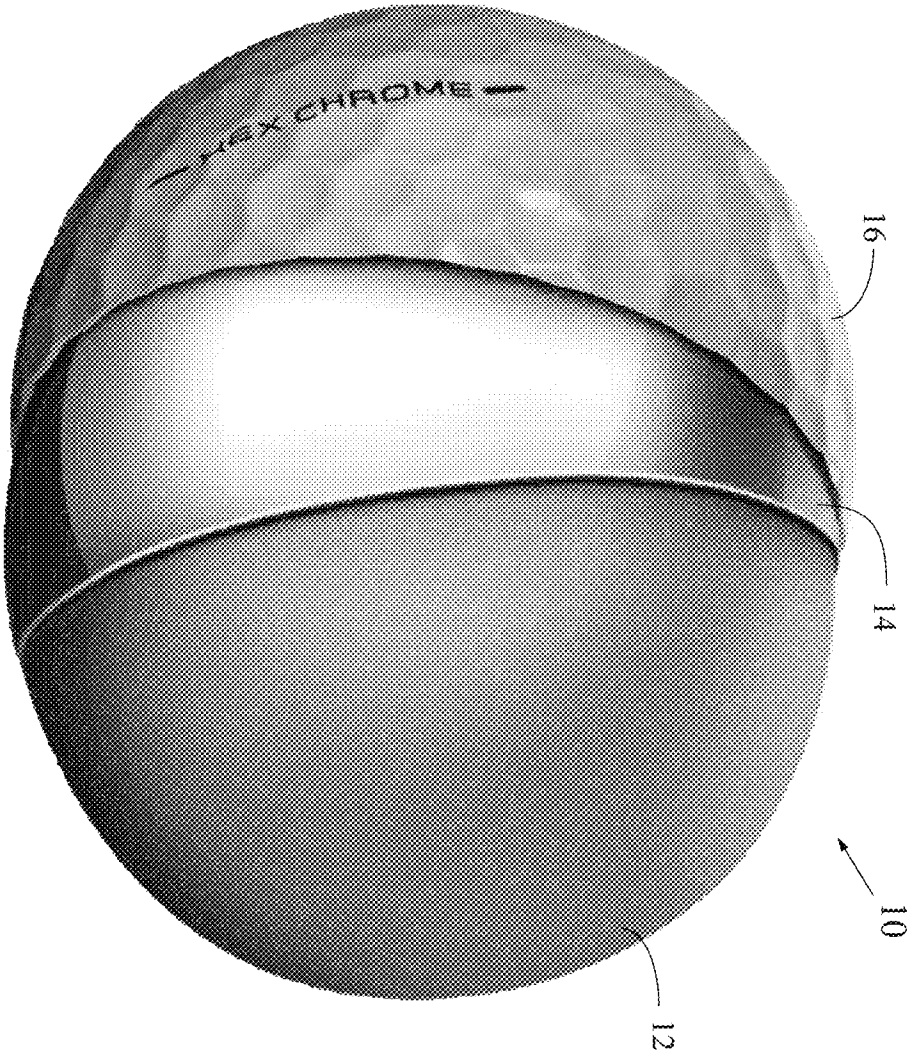
FIG. 21 is an exploded partial cut-away view of a three-piece golf ball.

FIG. 21 illustrates a three piece golf ball comprising a core, a boundary layer and a cover, with an internal circuitry comprising at least a BLUETOOTH Low Energy radio (5 generation), a processor, a magnetometer, an accelerometer, and a battery. The internal circuit may also have a memory.

Figure 22:
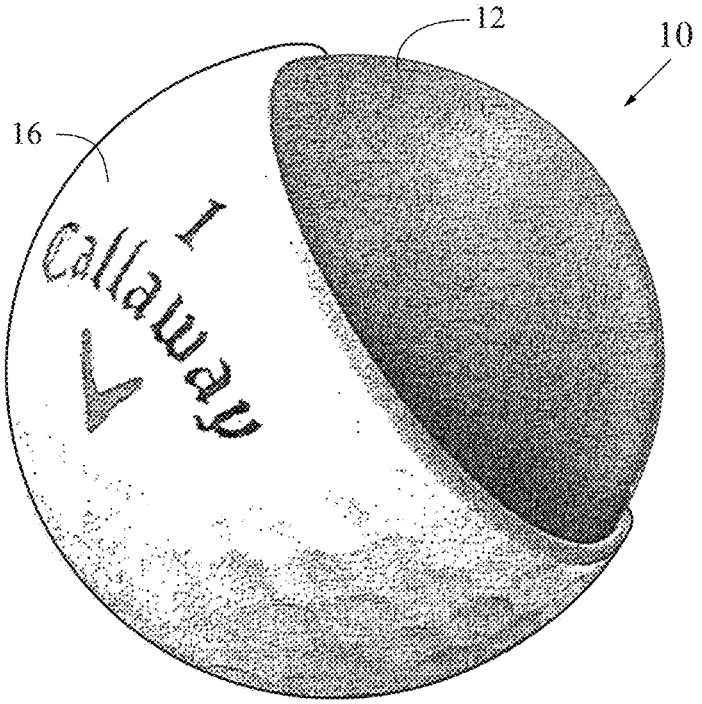
FIG. 22 is an exploded partial cut-away view of a two-piece golf ball.
Figure 23:
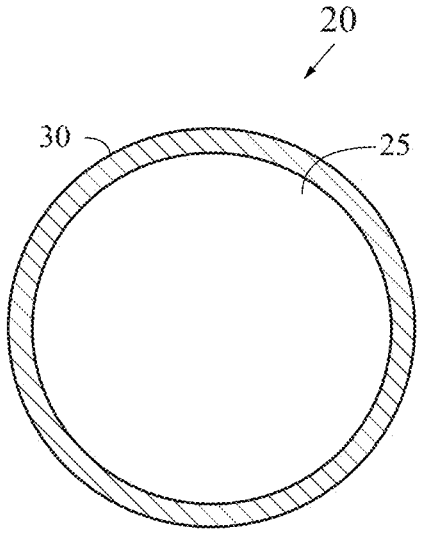
FIG. 23 is a cross-sectional view of a two-piece golf ball.

FIGS. 22 and 23 illustrate a two piece golf ball 20 with a core 25 and a cover 30 formed of a sprayed polyurea with a thickness ranging from 0.010 inch to 0.040 inch.

Figure 24:
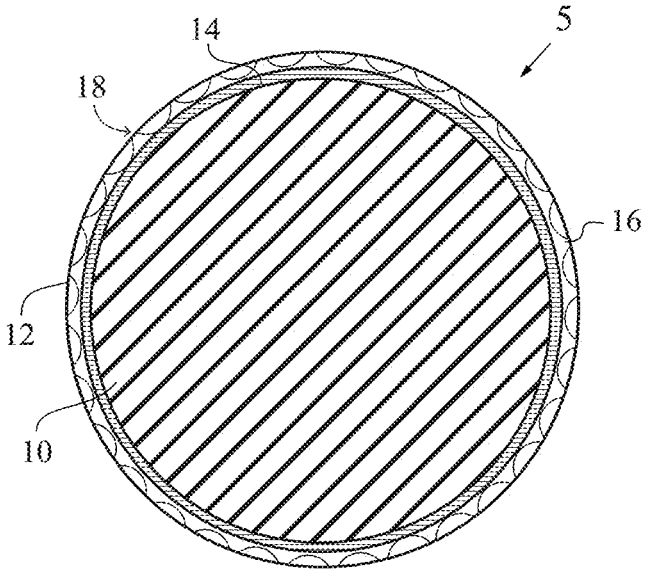
FIG. 24 is a cross-sectional view of a three-piece golf ball.
Figure 25:
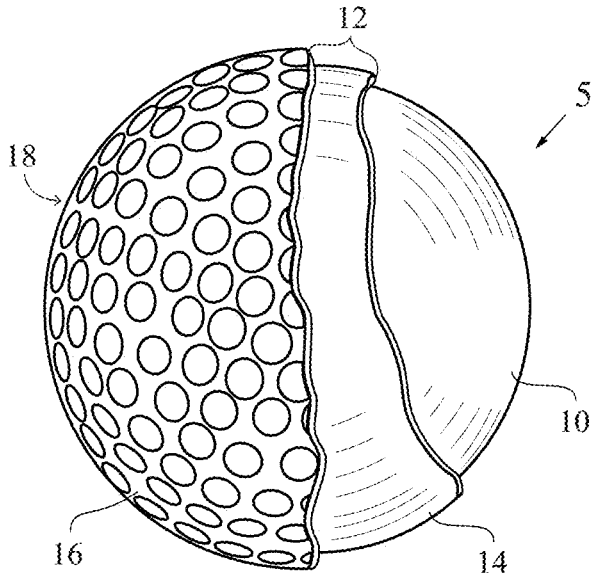
FIG. 25 is an exploded partial cut-away view of a three-piece golf ball.

FIGS. 24 and 25 illustrate a three-piece golf ball 5 comprising a core 10, a mantle layer 14 and a cover 16 with dimples 18, with an internal circuitry comprising at least a BLUETOOTH Low Energy radio (5 generation), a processor, a magnetometer, an accelerometer, and a battery. The internal circuit may also have a memory.

Figure 26:
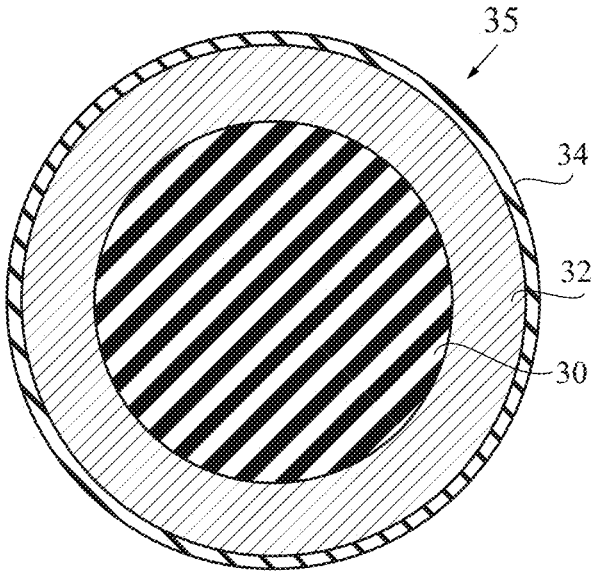
FIG. 26 is a cross-sectional view of a three-piece golf ball with a dual core and a cover.

FIG. 26 illustrates a dual core three piece golf ball 35 comprising an inner core 30, and outer core 32 and a cover 34, with an internal circuitry comprising at least a BLUETOOTH Low Energy radio (5 generation), a processor, a magnetometer, an accelerometer, and a battery. The internal circuit may also have a memory h.

Figure 27:
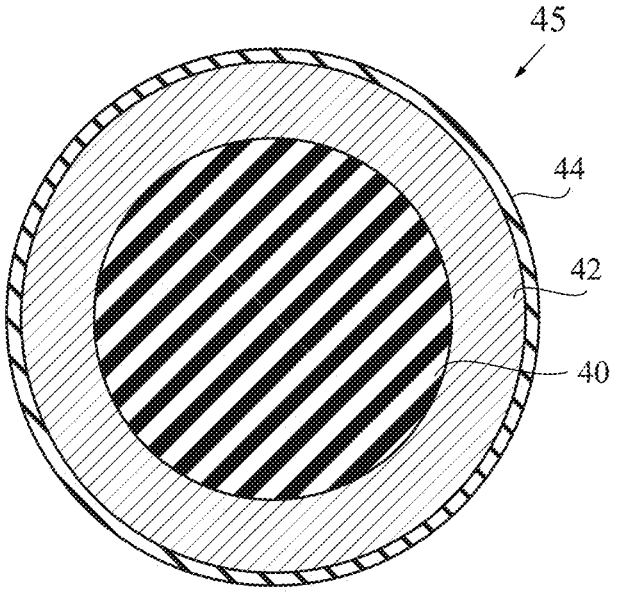
FIG. 27 is a cross-sectional view of a three-piece golf ball with a core, mantle and cover.

FIG. 27 illustrates a three piece golf ball 45 comprising a core 40, a mantle layer 42 and a cover 44, with an internal circuitry comprising at least a BLUETOOTH Low Energy radio (5 generation), a processor, a magnetometer, an accelerometer, and a battery. The internal circuit may also have a memory.

Figure 28:
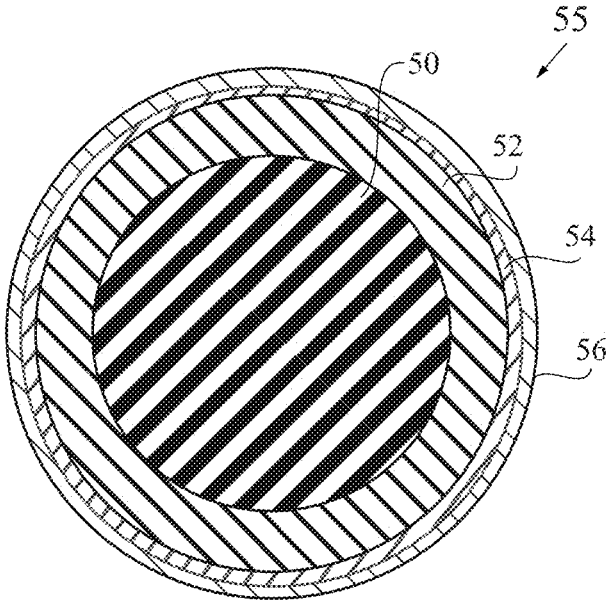
FIG. 28 is a cross-sectional view of a four-piece golf ball with a dual core, mantle layer and a cover.

FIG. 28 illustrates a dual core four piece golf ball 55 comprising an inner core 50, an outer core 52, a mantle layer 54 and a cover 56, with an internal circuitry comprising at least a BLUETOOTH Low Energy radio (5 generation), a processor, a magnetometer, an accelerometer, and a battery. The internal circuit may also have a memory.

Figure 29:
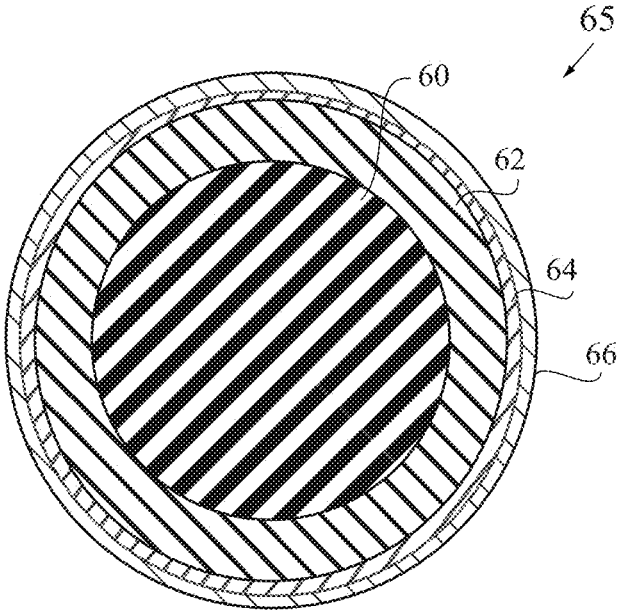
FIG. 29 is a cross-sectional view of a four-piece golf ball with a core, dual mantle layers and a cover.

FIG. 29 illustrates a four piece golf ball 65 comprising a core 60, an inner mantle 62, an outer mantle 64 and a cover 66, with an internal circuitry comprising at least a BLUETOOTH Low Energy radio (5 generation), a processor, a magnetometer, an accelerometer, and a battery. The internal circuit may also have a memory.

The mantle component is preferably composed of the inner mantle layer and the outer mantle layer. The mantle component preferably has a thickness ranging from 0.05 inch to 0.15 inch, and more preferably from 0.06 inch to 0.08 inch. The outer mantle layer is preferably composed of a blend of ionomer materials. One preferred embodiment comprises SURLYN 9150 material, SURLYN 8940 material, a SURLYN AD1022 material, and a masterbatch. The SURLYN 9150 material is preferably present in an amount ranging from 20 to 45 weight percent of the cover, and more preferably 30 to 40 weight percent. The SURLYN 8945 is preferably present in an amount ranging from 15 to 35 weight percent of the cover, more preferably 20 to 30 weight percent, and most preferably 26 weight percent. The SURLYN 9945 is preferably present in an amount ranging from 30 to 50 weight percent of the cover, more preferably 35 to 45 weight percent, and most preferably 41 weight percent. The SURLYN 8940 is preferably present in an amount ranging from 5 to 15 weight percent of the cover, more preferably 7 to 12 weight percent, and most preferably 10 weight percent.

SURLYN 8320, from DuPont, is a very-low modulus ethylene/methacrylic acid copolymer with partial neutralization of the acid groups with sodium ions. SURLYN 8945, also from DuPont, is a high acid ethylene/methacrylic acid copolymer with partial neutralization of the acid groups with sodium ions. SURLYN 9945, also from DuPont, is a high acid ethylene/methacrylic acid copolymer with partial neutralization of the acid groups with zinc ions. SURLYN 8940, also from DuPont, is an ethylene/methacrylic acid copolymer with partial neutralization of the acid groups with sodium ions.

The inner mantle layer is preferably composed of a blend of ionomers, preferably comprising a terpolymer and at least two high acid (greater than 18 weight percent) ionomers neutralized with sodium, zinc, magnesium, or other metal ions. The material for the inner mantle layer preferably has a Shore D plaque hardness ranging preferably from 35 to 77, more preferably from 36 to 44, a most preferably approximately 40. The thickness of the outer mantle layer preferably ranges from 0.025 inch to 0.050 inch, and is more preferably approximately 0.037 inch. The mass of an insert including the dual core and the inner mantle layer preferably ranges from 32 grams to 40 grams, more preferably from 34 to 38 grams, and is most preferably approximately 36 grams. The inner mantle layer is alternatively composed of a HPF material available from DuPont. Alternatively, the inner mantle layer 14*b* is composed of a material such as disclosed in Kennedy, III et al., U.S. Pat. No. 7,361,101 for a Golf Ball And Thermoplastic Material, which is hereby incorporated by reference in its entirety.

The outer mantle layer is preferably composed of a blend of ionomers, preferably comprising at least two high acid (greater than 18 weight percent) ionomers neutralized with sodium, zinc, or other metal ions. The blend of ionomers also preferably includes a masterbatch. The material of the outer mantle layer preferably has a Shore D plaque hardness ranging preferably from 55 to 75, more preferably from 65 to 71, and most preferably approximately 67. The thickness of the outer mantle layer preferably ranges from 0.025 inch to 0.040 inch, and is more preferably approximately 0.030 inch. The mass of the entire insert including the core, the inner mantle layer and the outer mantle layer preferably ranges from 38 grams to 43 grams, more preferably from 39 to 41 grams, and is most preferably approximately 41 grams.

In an alternative embodiment, the inner mantle layer is preferably composed of a blend of ionomers, preferably comprising at least two high acid (greater than 18 weight percent) ionomers neutralized with sodium, zinc, or other metal ions. The blend of ionomers also preferably includes a masterbatch. In this embodiment, the material of the inner mantle layer has a Shore D plaque hardness ranging preferably from 55 to 75, more preferably from 65 to 71, and most preferably approximately 67. The thickness of the outer mantle layer preferably ranges from 0.025 inch to 0.040 inch, and is more preferably approximately 0.030 inch. Also in this embodiment, the outer mantle layer 14*b* is composed of a blend of ionomers, preferably comprising a terpolymer and at least two high acid (greater than 18 weight percent) ionomers neutralized with sodium, zinc, magnesium, or other metal ions. In this embodiment, the material for the outer mantle layer 14*b* preferably has a Shore D plaque hardness ranging preferably from 35 to 77, more preferably from 36 to 44, a most preferably approximately 40. The thickness of the outer mantle layer preferably ranges from 0.025 inch to 0.100 inch, and more preferably ranges from 0.070 inch to 0.090 inch.

In yet another embodiment wherein the inner mantle layer is thicker than the outer mantle layer and the outer mantle layer is harder than the inner mantle layer, the inner mantle layer is composed of a blend of ionomers, preferably comprising a terpolymer and at least two high acid (greater than 18 weight percent) ionomers neutralized with sodium, zinc, magnesium, or other metal ions. In this embodiment, the material for the inner mantle layer has a Shore D plaque hardness ranging preferably from 30 to 77, more preferably from 30 to 50, and most preferably approximately 40. In this embodiment, the material for the outer mantle layer has a Shore D plaque hardness ranging preferably from 40 to 77, more preferably from 50 to 71, and most preferably approximately 67. In this embodiment, the thickness of the inner mantle layer preferably ranges from 0.030 inch to 0.090 inch, and the thickness of the outer mantle layer ranges from 0.025 inch to 0.070 inch.

Preferably the inner core has a diameter ranging from 0.75 inch to 1.20 inches, more preferably from 0.85 inch to 1.05 inch, and most preferably approximately 0.95 inch. Preferably the inner core 12*a* has a Shore D hardness ranging from 20 to 50, more preferably from 25 to 40, and most preferably approximately 35. Preferably the inner core is formed from a polybutadiene, zinc diacrylate, zinc oxide, zinc stearate, a peptizer and peroxide. Preferably the inner core has a mass ranging from 5 grams to 15 grams, 7 grams to 10 grams and most preferably approximately 8 grams.

Preferably the outer core has a diameter ranging from 1.25 inch to 1.55 inches, more preferably from 1.40 inch to 1.5 inch, and most preferably approximately 1.5 inch. Preferably the inner core has a Shore D surface hardness ranging from 40 to 65, more preferably from 50 to 60, and most preferably approximately 56. Preferably the inner core is formed from a polybutadiene, zinc diacrylate, zinc oxide, zinc stearate, a peptizer and peroxide. Preferably the combined inner core and outer core have a mass ranging from 25 grams to 35 grams, 30 grams to 34 grams and most preferably approximately 32 grams.

Figure 16:
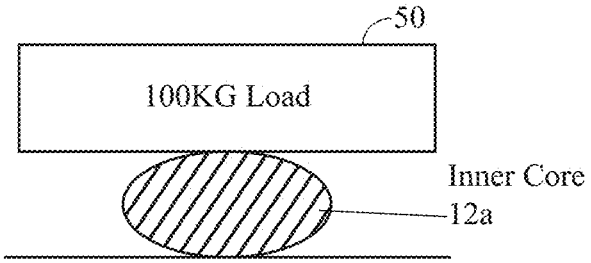
FIG. 16 is a cross-sectional view of an inner core layer under a 100 kilogram load.
Figure 17:
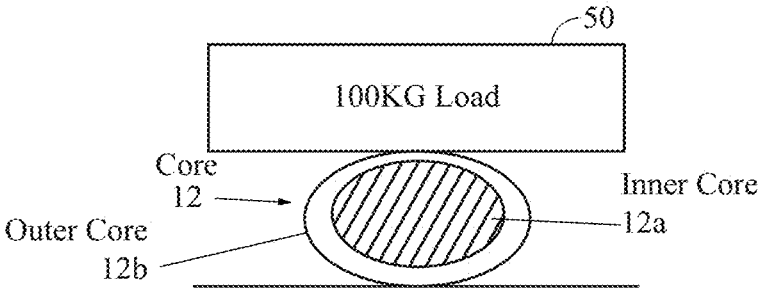
FIG. 17 is a cross-sectional view of a core under a 100 kilogram load.

Preferably the inner core has a deflection of at least 0.230 inch under a load of 220 pounds, and the core has a deflection of at least 0.080 inch under a load of 200 pounds. As shown in FIGS. 16 and 17, a mass 50 is loaded onto an inner core and a core. As shown in FIGS. 16 and 17, the mass is 100 kilograms, approximately 220 pounds. Under a load of 100 kilograms, the inner core preferably has a deflection from 0.230 inch to 0.300 inch. Under a load of 100 kilograms, preferably the core has a deflection of 0.08 inch to 0.150 inch. Alternatively, the load is 200 pounds (approximately 90 kilograms), and the deflection of the core 12 is at least 0.080 inch. Further, a compressive deformation from a beginning load of 10 kilograms to an ending load of 130 kilograms for the inner core ranges from 4 millimeters to 7 millimeters and more preferably from 5 millimeters to 6.5 millimeters. The dual core deflection differential allows for low spin off the tee to provide greater distance, and high spin on approach shots.

In an alternative embodiment of the golf ball shown in FIG. 15A, the golf ball 10 comprises an inner core 12*a*, an intermediate core 12*b*, an outer core 12*b*, a mantle 14 and a cover 16. The golf ball 10 preferably has a diameter of at least 1.68 inches, a mass ranging from 45 grams to 47 grams, a COR of at least 0.79, a deformation under a 100 kilogram loading of at least 0.07 mm.

In one embodiment, the golf ball comprises a core, a mantle layer and a cover layer. The core comprises an inner core sphere, an intermediate core layer and an outer core layer. The inner core sphere comprises a polybutadiene material and has a diameter ranging from 0.875 inch to 1.4 inches. The intermediate core layer is composed of a highly neutralized ionomer and has a Shore D hardness less than 40. The outer core layer is composed of a highly neutralized ionomer and has a Shore D hardness less than 45. A thickness of the intermediate core layer is greater than a thickness of the outer core layer. The mantle layer is disposed over the core, comprises an ionomer material and has a Shore D hardness greater than 55. The cover layer is disposed over the mantle layer comprises a sprayed polyurea with a thickness ranging from 0.010 inch to 0.040 inch. The golf ball has a diameter of at least 1.68 inches. The mantle layer is harder than the outer core layer, the outer core layer is harder than the intermediate core layer, the intermediate core layer is harder than the inner core sphere, and the cover layer is softer than the mantle layer.

In another embodiment, shown in FIGS. 18 and 19, the golf ball 10 has a multi-layer core and multi-layer mantle. The golf ball includes a core, a mantle component and a cover layer. The core comprises an inner core sphere, an intermediate core layer and an outer core layer. The inner core sphere comprises a polybutadiene material and has a diameter ranging from 0.875 inch to 1.4 inches. The intermediate core layer is composed of a highly neutralized ionomer and has a Shore D hardness less than 40. The outer core layer is composed of a highly neutralized ionomer and has a Shore D hardness less than 45. A thickness of the intermediate core layer is greater than a thickness of the outer core layer 12*c*. The inner mantle layer is disposed over the core, comprises an ionomer material and has a Shore D hardness greater than 55. The outer mantle layer is disposed over the inner mantle layer, comprises an ionomer material and has a Shore D hardness greater than 60. The cover layer is disposed over the mantle component, comprises a sprayed polyurea with a thickness ranging from 0.010 inch to 0.040 inch. The golf ball has a diameter of at least 1.68 inches. The outer mantle layer is harder than the inner mantle layer, the inner mantle layer is harder than the outer core layer, the outer core layer is harder than the intermediate core layer, the intermediate core layer is harder than the inner core sphere, and the cover layer is softer than the outer mantle layer.

In a particularly preferred embodiment of the invention, the golf ball preferably has an aerodynamic pattern such as disclosed in Simonds et al., U.S. Pat. No. 7,419,443 for a Low Volume Cover For A Golf Ball, which is hereby incorporated by reference in its entirety. Alternatively, the golf ball has an aerodynamic pattern such as disclosed in Simonds et al., U.S. Pat. No. 7,338,392 for An Aerodynamic Surface Geometry For A Golf Ball, which is hereby incorporated by reference in its entirety.

Various aspects of the present invention golf balls have been described in terms of certain tests or measuring procedures. These are described in greater detail as follows.

As used herein, "Shore D hardness" of the golf ball layers is measured generally in accordance with ASTM D-2240 type D, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore D hardness of the cover is measured while the cover remains over the mantles and cores. When a hardness measurement is made on the golf ball, the Shore D hardness is preferably measured at a land area of the cover.

As used herein, "Shore A hardness" of a cover is measured generally in accordance with ASTM D-2240 type A, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore A hardness of the cover is measured while the cover remains over the mantles and cores. When a hardness measurement is made on the golf ball, Shore A hardness is preferably measured at a land area of the cover The resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (COR) of the ball and other factors. The initial velocity of the club, the mass of the club and the angle of the ball's departure are essentially provided by the golfer upon striking. Since club head speed, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the COR and the surface configuration of the ball.

The coefficient of restitution is the ratio of the outgoing velocity to the incoming velocity. In the examples of this application, the coefficient of restitution of a golf ball was measured by propelling a ball horizontally at a speed of 125+/−5 feet per second (fps) and corrected to 125 fps against a generally vertical, hard, flat steel plate and measuring the ball's incoming and outgoing velocity electronically. Speeds were measured with a pair of ballistic screens, which provide a timing pulse when an object passes through them. The screens were separated by 36 inches and are located 25.25 inches and 61.25 inches from the rebound wall. The ball speed was measured by timing the pulses from screen 1 to screen 2 on the way into the rebound wall (as the average speed of the ball over 36 inches), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel.

As indicated above, the incoming speed should be 125±5 fps but corrected to 125 fps. The correlation between COR and forward or incoming speed has been studied and a correction has been made over the ±5 fps range so that the COR is reported as if the ball had an incoming speed of exactly 125.0 fps.

The measurements for deflection, compression, hardness, and the like are preferably performed on a finished golf ball as opposed to performing the measurement on each layer during manufacturing.

Preferably, in a five layer golf ball comprising an inner core, an outer core, an inner mantle layer, an outer mantle layer and a cover, the hardness/compression of layers involve an inner core with the greatest deflection (lowest hardness), an outer core (combined with the inner core) with a deflection less than the inner core, an inner mantle layer with a hardness less than the hardness of the combined outer core and inner core, an outer mantle layer with the hardness layer of the golf ball, and a cover with a hardness less than the hardness of the outer mantle layer. These measurements are preferably made on a finished golf ball that has been torn down for the measurements.

Preferably the inner mantle layer is thicker than the outer mantle layer or the cover layer. The dual core and dual mantle golf ball creates an optimized velocity-initial velocity ratio (Vi/IV), and allows for spin manipulation. The dual core provides for increased core compression differential resulting in a high spin for short game shots and a low spin for driver shots. A discussion of the USGA initial velocity test is disclosed in Yagley et al., U.S. Pat. No. 6,595,872 for a Golf Ball With High Coefficient Of Restitution, which is hereby incorporated by reference in its entirety. Another example is Bartels et al., U.S. Pat. No. 6,648,775 for a Golf Ball With High Coefficient Of Restitution, which is hereby incorporated by reference in its entirety.

Alternatively, the cover 16 is composed of a thermoplastic polyurethane/polyurea material. One example is disclosed in U.S. Pat. No. 7,367,903 for a Golf Ball, which is hereby incorporated by reference in its entirety. Another example is Melanson, U.S. Pat. No. 7,641,841, which is hereby incorporated by reference in its entirety. Another example is Melanson et al, U.S. Pat. No. 7,842,211, which is hereby incorporated by reference in its entirety. Another example is Matroni et al., U.S. Pat. No. 7,867,111, which is hereby incorporated by reference in its entirety. Another example is Dewanjee et al., U.S. Pat. No. 7,785,522, which is hereby incorporated by reference in its entirety.

Bartels, U.S. Pat. No. 9,278,260, for a Low Compression Three-Piece Golf Ball With An Aerodynamic Drag Rise At High Speeds, is hereby incorporated by reference in its entirety.

Chavan et al, U.S. Pat. No. 9,789,366, for a Graphene Core For A Golf Ball, is hereby incorporated by reference in its entirety.

Chavan et al, U.S. patent Ser. No. 10/039,959, for a Graphene Core For A Golf Ball, is hereby incorporated by reference in its entirety.

Chavan et al, U.S. patent Ser. No. 10/058,741, for a Carbon Nanotubes Reinforced Dual Core A Golf Ball, is hereby incorporated by reference in its entirety.

Simonds et al., U.S. Pat. No. 9,707,454 for a Limited Flight Golf Ball With Embedded RFID Chip is hereby incorporated by reference in its entirety.

Simonds et al., U.S. patent Ser. No. 10/252,117 for a Graphene Core Golf Ball With An Integrated Circuit is hereby incorporated by reference in its entirety.

Balardeta et al., U.S. Pat. No. 8,355,869 for a Golf GPS Device is hereby incorporated by reference in its entirety.

Raposo, U.S. Pat. No. 8,992,346 for a Method And System For Swing Analysis is hereby incorporated by reference in its entirety.

Balardeta et al., U.S. Pat. No. 8,845,459 for a Method And System For Shot Tracking is hereby incorporated by reference in its entirety.

Raposo, U.S. patent application Ser. No. 16/157,998, filed on Oct. 11, 2018, for a Smart Golf Ball, is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf ball comprising:

an epoxy sphere comprising a body and an electrical component, the body composed of an epoxy material, wherein the body encompasses the electrical component, wherein the electrical component is flexible and is wrapped around at least one battery;

a core layer disposed on the epoxy sphere; and a cover layer disposed over the core layer.

2. The golf ball according to claim 1 wherein the core layer comprises polybutadiene material and a graphene material in an amount ranging from 0.1 to 5.0 weight percent of the outer core, wherein the outer core has a flexural modulus ranging from 80 MPa to 95 MPa.

3. The golf ball according to claim 1 wherein the electrical component comprises an integrated circuit, a gyroscope, a magnetometer and an antenna.

4. The golf ball according to claim 3 wherein the integrated circuit comprises a BLUETOOTH antenna, a 1 GigaHertz antenna, a microcontroller and a radiofrequency transceiver.

5. The golf ball according to claim 3 wherein the integrated circuit comprises a plurality of capacitors and at least one inductor.

6. The golf ball according to claim 1 wherein the electrical component has a width ranging from 5 to 20 mm, a height ranging from 5-20 mm and a length ranging from 5-20 mm.

7. The golf ball according to claim 1 wherein the epoxy sphere has a diameter ranging from 0.4 inch to 0.9 inch.

8. The golf ball according to claim 1 wherein the epoxy sphere has a diameter ranging from 0.45 inch to 0.6 inch.

9. The golf ball according to claim 1 wherein the electrical component is centered in the epoxy sphere.

10. The golf ball according to claim 1 wherein the electrical component detects a spin of the golf ball.

11. The golf ball according to claim 1 wherein the electrical component transmits a wireless signal to a mobile device.

12. The golf ball according to claim 1 further comprising:

an inner mantle layer disposed over the core layer, the inner mantle layer having a thickness ranging from 0.03 inch to 0.09 inch, the inner mantle layer composed of an ionomer material, the inner mantle layer material having a plaque Shore D hardness ranging from 34 to 55;

an outer mantle layer disposed over the inner mantle layer, the outer mantle layer having a thickness ranging from 0.025 inch to 0.050 inch;

and wherein the cover layer is disposed over the outer mantle layer, the cover layer has a thickness ranging from 0.025 inch to 0.040 inch;

wherein the cover layer has a lower Shore D hardness than the outer mantle layer, the outer mantle layer has a higher Shore D hardness than the inner mantle layer, the core layer has a higher Shore D hardness than the inner mantle layer.

13. A golf ball comprising:

an epoxy sphere comprising a body and an electrical component, the body composed of an epoxy material, wherein the body encompasses the electrical component, wherein the electrical component is in electrical communication with the at least on battery at three contact points;

a core layer disposed on the epoxy sphere; and a cover layer disposed over the core layer.

14. A golf ball comprising:

an epoxy sphere comprising a body and a flexible circuit board wrapped around at least one battery, the flexible circuit board comprising a microcontroller, a gyroscope, a magnetometer, an accelerometer and an antenna, the body composed of an epoxy material, wherein the body encompasses the flexible circuit board wrapped around at least one battery;

a core layer disposed on the epoxy sphere comprising a polybutadiene and a graphene material in an amount ranging from 0.1 to 5.0 weight percent of the outer core, wherein the outer core has a flexural modulus ranging from 80 MPa to 95 MPa;

a mantle layer disposed over the core layer; and a cover disposed over the mantle layer.

15. The golf ball according to claim 14 wherein the mantle layer comprises an inner mantle layer and an outer mantle layer.

16. The golf ball according to claim 14 wherein the graphene material in the outer core ranges from 0.4 to 2.5 weight percent of the core, and wherein the graphene material in the inner core ranges from 0.4 to 2.5 weight percent of the inner core.

17. The golf ball according to claim 14 wherein the core has a tensile modulus ranging from 8 MPa to 10 MPa.

18. The golf ball according to claim 14 wherein a core has a compression value ranging from 40 to 55.

* * * * *